US009109295B2

(12) United States Patent
Reid et al.

(10) Patent No.: US 9,109,295 B2
(45) Date of Patent: Aug. 18, 2015

(54) ELECTROLYTE CONCENTRATION CONTROL SYSTEM FOR HIGH RATE ELECTROPLATING

(75) Inventors: Jonathan D. Reid, Sherwood, OR (US); Seshasayee Varadarajan, Lake Oswego, OR (US); Steven T. Mayer, Lake Oswego, OR (US)

(73) Assignee: Novellus Systems, Inc., Fremont, CA (US)

( * ) Notice: Subject to any disclaimer, the term of this patent is extended or adjusted under 35 U.S.C. 154(b) by 1579 days.

(21) Appl. No.: 12/577,619

(22) Filed: Oct. 12, 2009

(65) Prior Publication Data

US 2011/0083965 A1 Apr. 14, 2011

(51) Int. Cl.

| | |
|---|---|
| ***C25D 17/00*** | (2006.01) |
| ***C25D 21/18*** | (2006.01) |
| ***C25D 3/38*** | (2006.01) |
| ***C25D 21/02*** | (2006.01) |
| ***C25D 21/14*** | (2006.01) |
| ***C25D 7/12*** | (2006.01) |

(52) U.S. Cl.

CPC *C25D 17/00* (2013.01); *C25D 3/38* (2013.01); *C25D 7/123* (2013.01); *C25D 17/001* (2013.01); *C25D 21/02* (2013.01); *C25D 21/14* (2013.01); *C25D 21/18* (2013.01)

(58) Field of Classification Search

CPC ..... C25D 17/001; C25D 7/123; C25D 21/02; C25D 21/18

USPC ..... 204/232

See application file for complete search history.

(56) References Cited

U.S. PATENT DOCUMENTS

| | | | | |
|---|---|---|---|---|
| H36 H * | 3/1986 | Smith | 205/81 |
| 5,858,196 A * | 1/1999 | Ikenaga | 205/82 |
| 6,113,771 A | 9/2000 | Landau et al. | |
| 6,261,433 B1 | 7/2001 | Landau | |

(Continued)

FOREIGN PATENT DOCUMENTS

| | | |
|---|---|---|
| CN | 1679154 | 10/2005 |
| JP | 09-223858 | 8/1997 |

(Continued)

OTHER PUBLICATIONS

Reid et al, "Process for Through Silicon Via Filing", U.S. Appl. No. 12/193,644, filed Aug. 18, 2008.

(Continued)

*Primary Examiner* — Bryan D. Ripa

(74) *Attorney, Agent, or Firm* — Weaver Austin Villeneuve & Sampson LLP

(57) ABSTRACT

An electroplating apparatus for filling recessed features on a semiconductor substrate includes an electrolyte concentrator configured for concentrating an electrolyte having $Cu^{2+}$ ions to form a concentrated electrolyte solution that would have been supersaturated at 20° C. The electrolyte is maintained at a temperature that is higher than 20° C., such as at least at about 40° C. The apparatus further includes a concentrated electrolyte reservoir and a plating cell, where the plating cell is configured for electroplating with concentrated electrolyte at a temperature of at least about 40° C. Electroplating with electrolytes having $Cu^{2+}$ concentration of at least about 60 g/L at temperatures of at least about 40° C. results in very fast copper deposition rates, and is particularly well-suited for filling large, high aspect ratio features, such as through-silicon vias.

19 Claims, 9 Drawing Sheets

(56) References Cited

U.S. PATENT DOCUMENTS

| | | | | |
|---|---|---|---|---|
| 6,350,366 | B1 | 2/2002 | Landau et al. | |
| 6,576,111 | B1 * | 6/2003 | Hupe et al. | 205/101 |
| 7,670,950 | B2 | 3/2010 | Richardson et al. | |
| 7,776,741 | B2 | 8/2010 | Reid et al. | |
| 8,043,967 | B2 | 10/2011 | Reid et al. | |
| 2003/0079683 | A1 | 5/2003 | Nakano et al. | |
| 2003/0106802 | A1 | 6/2003 | Hagiwara et al. | |
| 2003/0186540 | A1 | 10/2003 | Ito et al. | |
| 2004/0022940 | A1 | 2/2004 | Nagai et al. | |
| 2004/0134682 | A1 | 7/2004 | En et al. | |
| 2004/0154917 | A1 * | 8/2004 | Ishida | 204/263 |
| 2005/0000814 | A1 * | 1/2005 | Metzger | 205/69 |
| 2005/0241946 | A1 | 11/2005 | Nagai et al. | |
| 2006/0144699 | A1 * | 7/2006 | Klocke | 204/228.6 |
| 2007/0158202 | A1 * | 7/2007 | Nagai et al. | 205/101 |
| 2007/0235341 | A1 * | 10/2007 | Mizohata et al. | 205/81 |
| 2009/0038947 | A1 * | 2/2009 | Dubin et al. | 205/101 |
| 2010/0041226 | A1 | 2/2010 | Reid et al. | |
| 2010/0200412 | A1 | 8/2010 | Reid et al. | |
| 2011/0083965 | A1 | 4/2011 | Reid et al. | |
| 2012/0031768 | A1 | 2/2012 | Reid et al. | |

FOREIGN PATENT DOCUMENTS

| | | |
|---|---|---|
| JP | 2003-113479 | 4/2003 |
| KR | 10-1999-0015599 | 3/1999 |
| KR | 10-2002-0077811 | 10/2002 |
| WO | WO 2010/022009 | 2/2010 |

OTHER PUBLICATIONS

US Notice of Allowance, dated Jan. 28, 2010, issued in U.S. Appl. No. 12/193,644.

US Notice of Allowance, dated May 3, 2010, issued in U.S. Appl. No. 12/193,644.

US Office Action, dated Mar. 22, 2011, issued in U.S. Appl. No. 12/762,275.

US Notice of Allowance, dated Jul. 18, 2011, issued in U.S. Appl. No. 12/762,275.

WO International Search Report and Written Opinion dated Mar. 11, 2010 issued in PCT/US2009/054094.

CN Office Action dated Dec. 5, 2012 for CN Application No. 200980132002.3.

KR Notice of Allowance dated Oct. 4, 2011 for KR Application No. 2010-7026766.

US Office Action, dated Aug. 27, 2013, issued in U.S. Appl. No. 13/270,897.

PCT International Preliminary Report on Patentability and Written Opinion dated Mar. 3, 2011 issued in PCT/US2009/054094.

Chinese Second Office Action dated Aug. 9, 2013 issued in CN 200980132002.3.

* cited by examiner

ELECTROLYTE CONCENTRATION CONTROL SYSTEM FOR HIGH RATE ELECTROPLATING

FIELD OF THE INVENTION

The present invention relates generally to methods and apparatus for electrodepositing metals on semiconductor substrates having recessed features and more particularly to methods and apparatus for electroplating copper for filling through silicon vias (TSVs).

BACKGROUND OF THE INVENTION

A TSV is a vertical electrical connection passing completely through a silicon wafer or die. TSV technology is important in creating 3D packages and 3D integrated circuits (IC). It provides interconnection of vertically aligned electronic devices through internal wiring that significantly reduces complexity and overall dimensions of a multi-chip electronic circuit.

A typical TSV process involves forming TSV holes and depositing conformal diffusion barrier and conductive seed layers, followed by filling of TSV holes with a metal. Copper is typically used as the conductive metal in TSV fill as it supports high current densities experienced at complex integration, such as 3D packages and 3D integrated circuits, and increased device speed. Furthermore, copper has good thermal conductivity and is available in a highly pure state.

TSV holes typically have high aspect ratios making void-free deposition of copper into such structures a challenging task. CVD deposition of copper requires complex and expensive precursors, while PVD deposition often results in voids and limited step coverage. Electroplating is a more common method of depositing copper into TSV structures; however, electroplating also presents a set of challenges because of the TSV's large size and high aspect ratio.

In a typical TSV electrofilling process, the substrate is contacted with a plating solution which includes copper sulfate as a source of copper ions, sulfuric acid for controlling conductivity, chloride ion to enhance suppressor adsorption and several other additives. However, the use of standard commercially available electrolytes often results in very slow plating and in formation of voids during TSV filling. For example, a typical electrolyte is prepared by combining a solution of copper sulfate, which is supplied at $Cu^{2+}$ concentration of less than 65 g/L with concentrated or 50% concentrated sulfuric acid. Pre-mixed electrolytes containing both copper salt and an acid are also available, however they typically have $Cu^{2+}$ concentrations of less than 60 g/L. In both cases, the commercially available solutions are prepared at such concentrations so as to avoid precipitation of copper salts at shipping and storage temperature of between about 0-10° C.

SUMMARY

It is herein provided that the use of commercially available electrolytes which are unsaturated at 0° C., results in plating rates which may be unacceptably slow (e.g., an hour or more for TSV fill), and may also be associated with increased formation of voids during TSV filling.

The present invention, in one aspect, provides methods and associated apparatus for filling TSVs at very high rates. In some embodiments, this involves using an electrolyte, which has a very high concentration of $Cu^{2+}$ ions, typically significantly higher than concentrations provided by commercially available electrolytes. In some embodiments, the electrolyte further includes an acid (e.g., sulfuric acid, an alkylsulfonic acid, mixtures of acids, etc.) at a relatively high concentration, such as at a concentration of between about 0.1-2M. In some embodiments the concentration of acid of at least about 0.6 M is preferred. For example, in some embodiments, the electrolyte contains sulfuric acid at a concentration of between about 40-200 g/L, such as between about 100-200 g/L, preferably at least about 60 g/L.

Further, in many embodiments, electroplating with this concentrated electrolyte is performed at elevated temperatures, such as at least at about 40° C. In some embodiments, electroplating is performed using an electrolyte solution that would have been beyond its saturation limit (i.e., would have formed a precipitate) at a first temperature, wherein the electroplating is performed at a temperature that is at least 10° C. or 20° C. higher than the highest temperature at which the electrolyte is saturated. For example, in some embodiments, electroplating is performed at a temperature of at least about 20° C. with an electrolyte solution which would have formed a precipitate at 0° C. In other embodiments, electroplating is performed at a temperature of at least about 40° C. with a concentrated electrolyte solution, which would have formed a precipitate at 20° C.

In another aspect, the present invention provides an apparatus and associated methods for preparing such concentrated electrolytes prior to use, and for integrating concentrated electrolyte preparation modules with an electroplating apparatus. Further, methods and apparatus for controlling electrolyte concentrations and temperatures are provided. Provided methods and apparatus are particularly useful for filling large high aspect ratio features, such as TSVs with copper, but are also generally applicable for depositing other metals on a variety of semiconductor substrates having recessed features.

In one embodiment an electroplating apparatus for depositing copper on a semiconductor substrate having one or more recessed features (such as TSVs) is provided. The apparatus includes (a) an electrolyte concentrator module configured for concentrating an electrolyte comprising a copper salt, the electrolyte concentrator module comprising an inlet port configured for receiving a non-concentrated electrolyte from a source of non-concentrated electrolyte, an outlet port configured for delivering warm concentrated electrolyte to a concentrated electrolyte reservoir, and a heater configured for maintaining the electrolyte in the concentrator module at a temperature of at least about 40° C.; (b) the concentrated electrolyte reservoir in fluidic communication with the concentrator module, wherein the reservoir is configured for receiving the warm concentrated electrolyte from the concentrator module and for delivering the warm concentrated electrolyte to an electroplating cell; and (c) the electroplating cell in fluidic communication with the concentrated electrolyte reservoir, wherein the electroplating cell is configured for receiving the warm concentrated electrolyte from the concentrated electrolyte reservoir, and for bringing the warm concentrated electrolyte in contact with the semiconductor substrate at the electrolyte temperature of at least about 40° C. (e.g., of at least about 50° C., such as of at least about 60° C.). In some embodiments, the apparatus also includes a source of non-concentrated electrolyte in fluidic communication with the concentrator module, wherein the source of non-concentrated electrolyte is configured for holding the non-concentrated electrolyte and for delivering the non-concentrated electrolyte to the inlet port of the concentrator module.

The concentrator module of the electroplating apparatus is configured for removing water from the non-concentrated electrolyte (e.g., by evaporation at elevated temperature and/ or by reverse osmosis). For example, in one embodiment, the concentrator is configured for removing water from the non-concentrated electrolyte to form the warm concentrated electrolyte having a temperature of at least about 40° C., wherein the formed warm concentrated electrolyte would have been supersaturated (would have formed precipitate) at 20° C. The concentrator module typically comprises a heater which is electrically connected to a temperature controller, which is configured to maintain the electrolyte temperature in the concentrator module at least at about 40° C. In some embodiments, the concentrator is configured for evaporating water from electrolyte at a temperature of at least about 70° C. In some embodiments, the concentrator is equipped with an inlet configured for receiving dry air and an outlet configured for removing wet air, while the concentrator is working.

The concentrator module further can include a concentration detector (e.g., an optical detector) connected with a concentration controller configured to maintain electrolyte concentration in the desired range. The electrolyte in the concentrator module typically includes $Cu^{2+}$ and $SO_4^{2-}$ ions, $H^+$ (acid), $Cl^-$ (chloride), but may also include other components. In one embodiment, the concentrator is configured to concentrate a solution consisting essentially of water with $Cu^{2+}$, $SO_4^{2-}$ (including associated sulfur-containing anions), $H^+$, and $Cl^-$ dissolved therein. The concentrator may further include a diluent port configured for receiving a diluent (e.g., DI water) from a diluent source, for example when concentration of electrolyte starts exceeding the desired concentration, and to prevent (or reverse) precipitation of copper salts.

In some embodiments, the concentrator module comprises a recirculation line connected to the electrolyte outlet port, wherein the line is configured for recirculating the warm concentrated electrolyte within the concentrator module and comprising a filter configured for filtering the recirculated electrolyte, wherein the recirculation line is in fluidic communication with the concentrated electrolyte reservoir, and is further configured for delivering the warm filtered concentrated electrolyte to the concentrated electrolyte reservoir.

After the concentrated electrolyte solution (which often has a $Cu^{2+}$ concentration of 85 g/L and more) is formed in the concentrator module, it is directed to a concentrated electrolyte reservoir. The reservoir typically also comprises a heater which is electrically connected to a temperature controller, which is configured to maintain the electrolyte temperature in the reservoir at least at about 40° C. The electrolyte temperatures in the concentrator module and in the reservoir need not necessarily be identical, with concentrator electrolyte temperature often being higher than electrolyte temperature in the reservoir. In each case, the temperatures and electrolyte concentrations are judiciously controlled, such that no precipitation from the concentrated solution is occurring. In some embodiments, the reservoir also includes a diluent port configured to deliver a diluent into the reservoir in order to prevent or reverse copper salt precipitation, or in order to optimize copper concentration in electrolyte solution. Further, in some embodiments the reservoir includes an additive port, which is configured to deliver additives, such as levelers, accelerators, and suppressors to the reservoir from an additive source.

After the concentrated electrolyte leaves the reservoir, it is directed to the plating cell where it is brought in contact with the substrate at a temperature of at least about 40° C., and where electrodeposition occurs. In one embodiment, the warm concentrated electrolyte is delivered continuously to the plating cell through an electrolyte entry port, and is removed through an electrolyte exit port. In some embodiments, the exiting electrolyte is directed through a recirculation line back to the concentrated electrolyte reservoir. Typically, there is a filter in the electrolyte recirculation loop which is adapted for removing insoluble matter from the electrolyte before it re-enters the reservoir. In other embodiments, the exiting electrolyte from the plating cell is directed to the concentrator module through the recirculation line.

In another aspect, the concentrated electrolyte is prepared by combining a concentrated solution of copper salt with a solution of acid. In one embodiment the electroplating apparatus includes (a) a concentrated electrolyte reservoir in fluidic communication with a source of concentrated copper salt and with a separate source of a concentrated acid, the reservoir configured for combining the concentrated solution of copper salt with the concentrated acid and forming a warm concentrated electrolyte solution having a temperature of at least about 40° C., wherein the solution would have formed a precipitate at 20° C.; and (b) an electroplating cell in fluidic communication with the concentrated electrolyte reservoir, wherein the electroplating cell is configured for receiving the warm concentrated electrolyte from the concentrated electrolyte reservoir, and for bringing the warm concentrated electrolyte in contact with the semiconductor substrate at the electrolyte temperature of at least about 40° C.

As it was mentioned above, while in many embodiments it is preferable to perform electroplating with concentrated electrolytes above room temperature, in some embodiments concentrated electroplating solutions which would have been supersaturated at 0° C. are prepared, and the plating is performed at 20° C. and above (but not necessarily above room temperature). In one aspect, the plating method for filling a TSV includes: (a) providing a non-concentrated electrolyte solution comprising at least one copper salt, wherein said solution is not saturated at 0° C. and at higher temperatures; (b) concentrating the non-concentrated electrolyte solution comprising said at least one copper salt to form a concentrated solution and maintaining said concentrated solution at a temperature of at least about 20° C., wherein said concentrated solution would have formed a precipitate at 0° C.; and (c) contacting the semiconductor substrate with the concentrated electrolyte solution at a temperature of at least about 20° C. in an electroplating apparatus to at least partially fill the through-silicon via with copper.

In another embodiment the method of TSV filling involves (a) forming a concentrated electrolyte solution by combining a concentrated solution comprising a copper salt with a concentrated solution of acid, said acid having the same anion as the copper salt, to form a concentrated electrolyte solution, wherein said concentrated solution would have formed a precipitate at 0° C., and wherein the formed concentrated solution is maintained at a temperature of at least about 20° C.; and (b) contacting the semiconductor substrate with the concentrated electrolyte solution at a temperature of at least about 20° C. in an electroplating apparatus to at least partially fill the through-silicon via with copper.

Of course, in some embodiments, the concentrated electrolyte is prepared at least at about 40° C. and is brought in contact with the substrate at least at about 40° C. The concentration of $Cu^{2+}$ in the formed concentrated electrolyte will depend on the saturation requirements for a particular electrolyte composition at 0° C. For example, when electrolytes having high concentration of common anion are used, such as copper sulfate electrolyte having high concentration of sulfuric acid, electrolytes with $Cu^{2+}$ concentrations of 40 g/L and above may be already supersaturated at 0° C. Such electrolytes would be difficult to obtain, unless methods described herein are used. Thus, in some embodiments, electrolytes having $Cu^{2+}$ concentration of 40 g/L and higher, such as 60 g/L and higher, such as 85 g/L and higher are formed. For electrolytes that do not include high concentrations of common anion, supersaturation at 0° C. can be achieved at $Cu^{2+}$ concentrations of 85 g/L and above.

These and other features and advantages of the present invention will be described in more detail with reference to the figures and associated description that follows.

DETAILED DESCRIPTION OF A PREFERRED EMBODIMENT

Figure 1A:
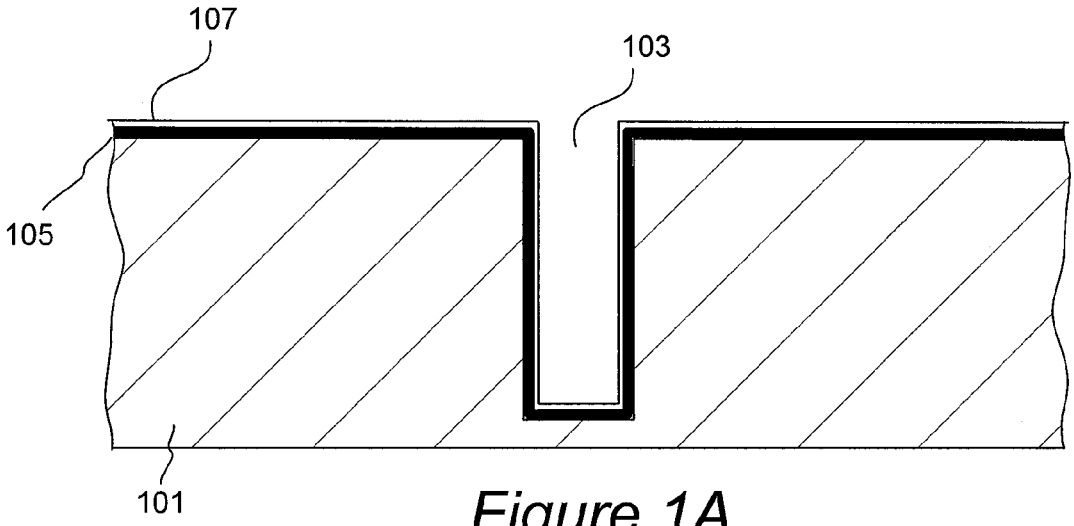
FIGS. 1A-1C present schematic representations of semiconductor device cross-sections at various stages of TSV processing.

In the following description, the invention is presented in terms of certain specific configurations and processes to help explain how it may be practiced. The invention is not limited to these specific embodiments. Examples of specific embodiments of the invention are illustrated in the accompanying drawings. While the invention will be described in conjunction with these specific embodiments, it will be understood that it is not intended to limit the invention to such specific embodiments. On the contrary, it is intended to cover alternatives, modifications, and equivalents as may be included within the scope and equivalents of the appended claims. In the following description, numerous specific details are set forth in order to provide a thorough understanding of the present invention. The present invention may be practiced without some or all of these specific details. In other instances, well known process operations have not been described in detail in order not to unnecessarily obscure the present invention.

In this disclosure various terms are used to describe a semiconductor work piece. For example, "wafer" and "substrate" are used interchangeably. The process of depositing, or plating, metal onto a conductive surface via an electrochemical reaction is referred to generally as electroplating or electrofilling. Copper-containing metal in this application is referred to as "copper" which includes without limitation, pure copper metal, copper alloys with other metals, and copper metal impregnated with non-metallic species, such as with organic and inorganic compounds used during electrofill operations (e.g., levelers, accelerators, suppressors, surface-active agents, etc.).

While high rate plating process will be primarily described making reference to copper plating, it is understood that the methods provided herein and associated apparatus configurations can be used to perform high rate plating of other metals and alloys, such as Au, Ag, Ni, Ru, Pd, Sn, Pb/Sn alloy, etc.

Further, while provided methods are particularly advantageous for filling relatively large recessed features, such as TSVs, they can also be used for filling smaller damascene features, or even for high rate plating on planarized substrates.

Electroplating at higher rates is desirable in many areas of semiconductor processing, but is particularly needed for filling relatively large, high aspect ratio recessed features on semiconductor substrates. Specifically, TSVs, which often have a diameter of more than about 3 micrometers and a depth of more than about 20 micrometers, and which in addition can have high aspect ratios (e.g., between about 5:1 and 10:1), are filled relatively slowly when conventional electrolytes and conventional plating systems are used. Further, in conventional systems, filling of such features often results in formation of voids due to disparities in electrodeposition rates at the bottom portions of the features and at the feature openings. For example, if electrodeposition rate at the bottom of the feature is insufficient, while electrodeposition rate at the feature opening is relatively high, the feature opening can close sooner than the feature is fully filled, thereby leaving a void in the feature. Accordingly, while it is generally desirable to increase electrodeposition rates to achieve faster plating, in some embodiments it is also desirable to increase deposition rates at the bottom of recessed feature relative to the deposition rate at the feature opening. In some embodiments, this is achieved by electroplating with electrolytes that have very high $Cu^{2+}$ ion concentration at elevated temperatures and with the use of additives which are configured to increase electrodeposition rates at the bottom portion of the recessed feature relative to electrodeposition rates at feature opening.

The highly concentrated electrolytes provided herein typically have component concentrations that exceed their saturation limit at 0° C. The electrolytes are often used at a temperature that is at least about 5 degrees, such as at least about 10 or 20 degrees, higher than the highest temperature at which the electrolyte is fully saturated, to ensure that no precipitation would occur during plating. In this application the "fully saturated electrolyte" refers to the composition that would have normally started to form a precipitate at the temperature to which the reference is made. In other words, concentrated electrolytes provided herein would have formed a precipitate at 0° C. but are typically used at a temperature of at least about 20° C., such as at a temperature of at least about 40° C. (e.g., at a temperature of between about 40° C. and 75° C.), at which temperatures all electrolyte components remain fully dissolved.

Such concentrated electrolytes typically are not commercially available. For example, when electrolytes containing copper sulfate and sulfuric acid are sold, even most concentrated mixtures, are designed such that they are capable of withstanding shipping and storage temperatures (e.g., 0° C-10° C.) without forming a precipitate, and therefore have lower concentrations than those desirable for plating in accordance with provided embodiments. Accordingly, methods for preparing concentrated electrolytes prior to plating, and an associated apparatus which includes concentrated electrolyte preparation module, are provided.

In some embodiments, the use of concentrated electrolytes provided herein allows complete filling of a TSV having a diameter of at least about 3 micrometers and a depth of at least about 20 micrometers over a period of less than about 20 minutes and in a substantially void free manner. In some embodiments, electrodeposition rates that are at least 5 times greater than rates obtained using conventional plating conditions are provided. For example plating rates of between about 10,000-50,000 Å/minute as measured based on the filled depth of the via as a function of time, can be achieved. In some embodiments, plating rates of at least about 25,000 Å/minute are preferred.

TSV Processing

Figure 1B:
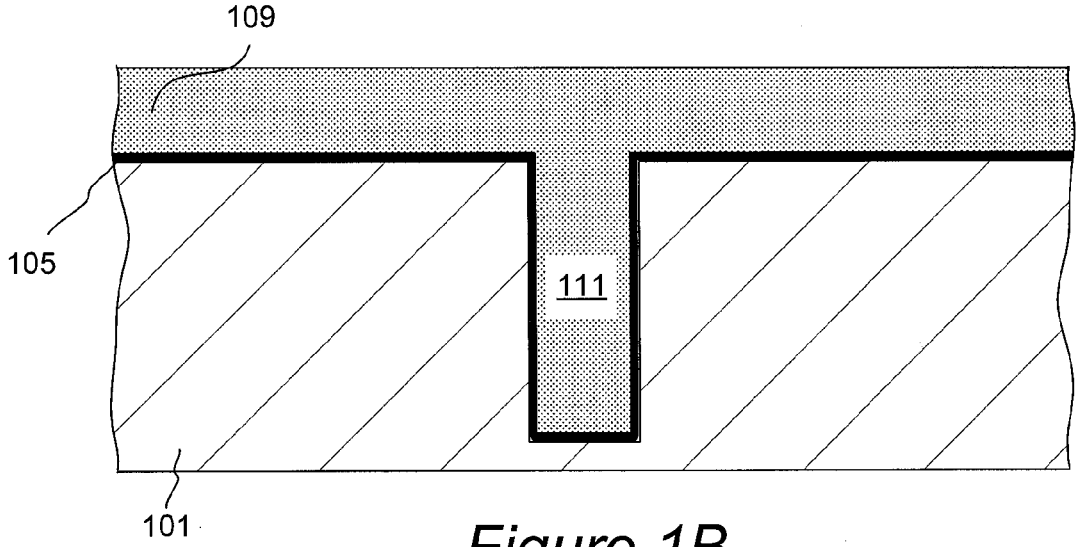
Figure 1C:
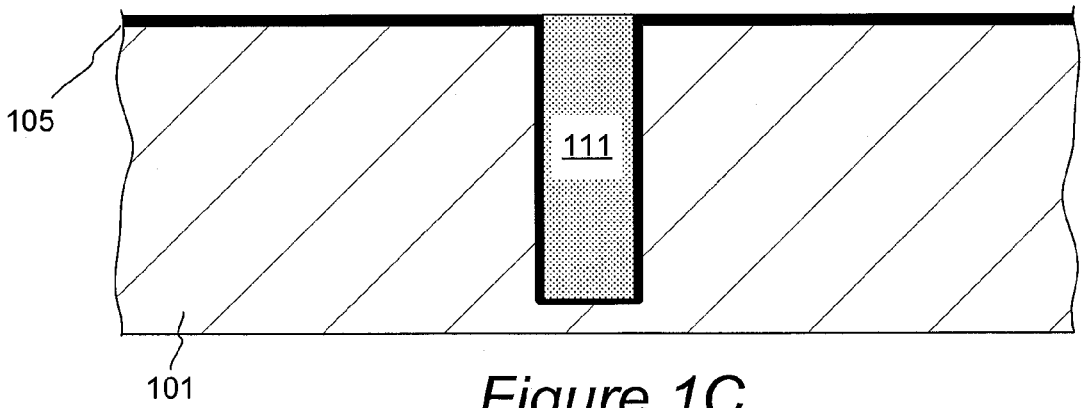

The integration of provided plating methods into damascene feature processing, will be now illustrated making reference to FIGS. 1A-1C, which show cross-sectional views of a substrate containing a through-silicon via (TSV) during various stages of processing. A TSV is a vertical electrical connection passing completely through a silicon wafer or a die. TSV technology may be used in 3D packages and 3D integrated circuits, sometimes collectively referred to as 3D stacking. For example, a 3D package may contain two or more integrated circuits (ICs) stacked vertically so that they occupy less space and have shorter communication distances between the various devices than in a 2D layout. Traditionally, stacked ICs are wired together along their edges, but such wiring design can still lead to significant signal transmission time delays, as well as to increases in the stack's dimensions, and usually requires additional redistribution layers to route signals to the periphery of the various ICs. Significantly greater numbers of shorter length, dense interconnections can be made by wiring the IC's directly though the silicon substrate, between each of the vertically stacked ICs. TSVs provide connections through the body of the ICs substrate leading to smaller compact stacks with greatly increased communication bandwidth. Similarly, a 3D single IC may be built by stacking several silicon wafers and interconnecting them vertically through each of the substrates. Such stacks behave as a single device and can have shorter critical electrical paths leading to faster operation. This approach is in many aspects technically superior to traditional peripheral wire-bonding interconnect methodology.

Electronic circuits using TSVs may be bonded in several ways. One method is "wafer-to-wafer", where two or more semiconductor wafers having circuitry are aligned, bonded, and diced into 3D ICs. Each wafer may be thinned before or after bonding. The thinning process includes removal of the wafer material to expose the bottom part of the TSV. TSVs may be formed into the wafers either before bonding or created in the stack after bonding and may pass through the silicon substrates between active layers and an external bond pad. Another method is "die-to-wafer" where only one wafer is diced and then the singled dies are aligned and bonded onto die sites of the second wafer. The third method is "die-to-die" where multiple dies are aligned and bonded. Similar to the first method, thinning and connections may be built at any stage in the last two methods. The integration of the high rate plating process into through-silicon via processing is not significantly affected by the sequence in which the through-silicon via is processed.

FIGS. 1A-1C illustrate processing of a TSV prior to wafer thinning, that is, the TSV at these processing stages does not reach all the way through the silicon wafer. A TSV may be used with both dies and wafers, generally referred here as semiconductor substrate 101. Examples of the material suitable for a semiconductor substrate 101 include, but are not limited to silicon, silicon on insulator, silicon on sapphire, and gallium arsenide. In some embodiments, the semiconductor substrate includes a layer of dielectric, such as silicon oxide based dielectric. In other cases the substrate may be more similar to a single level or multilevel circuit board, and can be made of a ceramic or embedded epoxy. Further in some embodiments the substrate may include circuitry or active transistor devices. These features are not shown to preserve clarity.

In a first cross-sectional view shown in FIG. 1A, a TSV hole 103 is formed in the semiconductor substrate 101. The depth of the TSV hole 103 must be sufficient to allow for a complete cutting through layer 101 during the subsequent thinning operation. Typically, TSV holes may be between about 5 to 400 microns deep (often between about 50 to 150 microns deep), however the present invention may be practiced with the TSV holes of other sizes as well. The diameter of TSV holes may vary between about 1 to 100 microns (more typically between about 5 to 25 microns). The TSV holes typically have a high aspect ratio, which is defined as the ratio of the TSV hole depth to the TSV hole diameter (usually at the opening). In certain embodiments, the TSV hole aspect ratio may vary between about 2:1 to 12:1 (such as between about 3:1 and 10:1). TSV size also depends on which stage of the overall 3D stacking process includes TSV formation. A TSV can be formed before ("via first") or after ("via last") stacking. In the "via-first" configuration, the TSV may be formed before or after creating CMOS structures. In the "via-last" configuration, the TSV may be formed before or after bonding. Moreover, in both configurations, thinning may be performed before or after bonding. The invention may be practiced with any TSV sizes or forming configurations described herein. Table 1 summarizes typical TSV dimensions (in micrometers) for various TSV configurations. While FIGS. 1A-1C and the corresponding description generally pertains to the configuration where a TSV is formed before stacking and CMOS processing and thinning are performed before bonding ("via-first"+before CMOS+thinning before bonding), this invention can be readily applied to other configurations.

TABLE 1

| | | "Via - First" | | "Via - Last" | |
|---|---|---|---|---|---|
| | | Before CMOS | After CMOS | Before Bonding | After Bonding |
| Diameter | Thinning Before | 2-5 | 5-20 | 20-50 | 5-50 |
| Depth | Bonding | 30-50 | 40-150 | 50-400 | 30-150 |
| Diameter | Thinning After | 1-5 | 1-5 | 3-5 | 3-5 |
| Depth | Bonding | 5-25 | 5-25 | 5-25 | 5-25 |

TSV holes may be formed using standard photolithographic and etching methods. Returning to FIG. 1A, the TSV hole 103 may be formed through a top surface, which may be an active surface of a wafer or a die and may include electronic devices. Alternatively, the TSV hole may be formed through the back surface of a wafer or a die where the circuitry is not present.

The cross-section in FIG. 1A shows that a layer of diffusion barrier material 105 resides over the substrate 101, and conformally lines the substrate both in the field and within the TSV 103. Suitable materials for the diffusion barrier layer 105 include tantalum, tantalum nitride, tungsten, titanium, ruthenium, titanium nitride, and alloyed and layered combinations of these and other materials. In a typical embodiment, the diffusion barrier layer 105 is formed by a PVD process, although other techniques such as chemical vapor deposition (CVD), electroless deposition, or atomic layer deposition (ALD) may be employed. The seed layer 107 is then deposited to provide a uniform conductive surface for current passage during an electroplating operation. As with the barrier layer deposition, a PVD method may be employed for this operation, although other processes such as electroless or electrolytic deposition may be employed as well. Suitable seed layer materials include metals such as copper, copper alloys, cobalt, nickel, ruthenium, etc. or combined layers such as Co/Cu or Ru/Cu. In some embodiments the seed layer can also perform a function of a diffusion barrier. In these embodiments, it may not be necessary to employ a separate diffusion barrier layer 105. Referring again to FIG. 1A, it can be seen that seed layer 107 conformally lines the substrate and resides on top of the diffusion barrier layer 105 both in the field and within the TSV.

Next, a copper layer 111 is deposited by electroplating onto the seed layer 107 (the seed layer is not shown in FIG. 1B to preserve clarity) to completely fill the TSV hole 111, as shown in FIG. 1B. Concentrated electrolyte solutions containing very high $Cu^{2+}$ concentrations are used in the plating process, preferably at elevated temperature of at least about 40° C. Electrolyte chemistry and plating conditions will be described in detail in the subsequent sections. During plating current is generated through the seed layer 103 causing copper ions to flow towards and deposit on the seed layer. Typically, during electrodeposition a copper overburden layer 109 is formed over the field region. In large feature size 3D packaging (e.g. TSV) application overburden typically has a thickness ranging from about 4 micrometers to 25 micrometers. In some embodiments, little or no overburden may form on the substrate after the TSV is filled. Suitable electrolyte chemistry for plating with little or no overburden is described in the commonly owned U.S. patent application Ser. No. 12/193,644, filed on Aug. 18, 2008, titled "Process for Through Silicon Via Filling" naming J. Reid et al. as inventors, which is herein incorporated by reference in its entirety.

After electrodeposition of copper is completed, the overburden 109 is removed in a post electroplating process, which may include wet chemical etching, chemical mechanical polishing (CMP), electroplanarization, and various combinations of these methods.

The next cross-section shown in FIG. 1C illustrates the substrate 101 after post-electroplating processes to remove copper overburden are completed. As shown, the overburden 109 is removed and the diffusion barrier layer 105 is exposed over the field region. In subsequent operations (not shown), the diffusion barrier material is removed from the field region (e.g., by CMP) and the substrate is thinned at the TSV bottom, to allow the TSV go entirely through the substrate.

Electrolyte Chemistry and Electrolyte Preparation

Figure 2A:
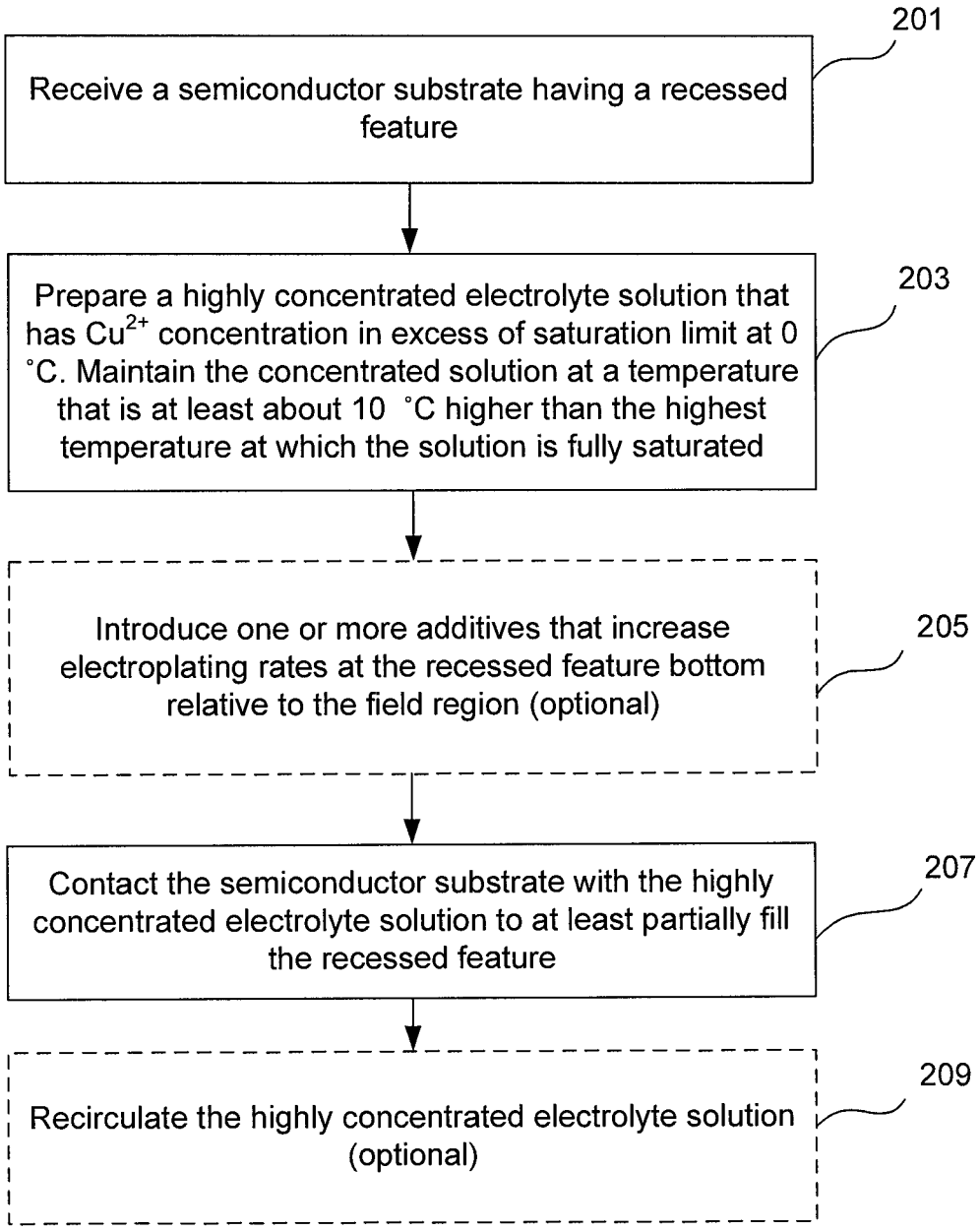
FIGS. 2A-2C present process flow diagrams illustrating processes for high rate electroplating in accordance with various embodiments.

An exemplary method for high rate electroplating is illustrated in the process flow diagram shown in FIG. 2A. In 201 a semiconductor substrate having a recessed feature is received. For example, the substrate may be a wafer or a die having one or more TSV holes. Independently, in operation 203, a highly concentrated electrolyte solution is prepared. The highly concentrated electrolyte has $Cu^{2+}$ concentration in excess of saturation limit at 0° C. The prepared electrolyte is maintained at a temperature that is at least about 10° C. higher than the highest temperature at which the solution is fully saturated (i.e. the highest temperature at which precipitate would have formed). For example, in some embodiments, the concentrated electrolyte is fully saturated at 0° C. and is maintained at room temperature (about 20° C.). In other embodiments, the concentrated electrolyte is fully saturated at room temperature (at 20° C.) and is maintained at a temperature of at least about 40° C., such as at a temperature of between about 40-75° C., for example at a temperature of between about 50-70° C.

The prepared electrolyte solution contains one or more copper salts, which may include without limitation copper sulfate, copper methanesulfonate, copper propanesulfonate, copper gluconate, copper pyrophosphate, copper sulfamate, copper nitrate, copper phosphate, copper chloride, and their various combinations.

In some embodiments, the prepared concentrated electrolyte further includes an acid, such as sulfuric acid, methanesulfonic acid, propanesulfonic acid, nitric acid, phosphoric acid, hydrochloric acid and various combinations thereof. For example, the electrolyte solution in one embodiment contains copper sulfate and sulfuric acid.

In some embodiments, although not necessarily, the concentrated solution provided herein has a relatively high concentration of acid in addition to high concentration of $Cu^{2+}$. This is particularly significant for TSV filling because a voltage drop in the electrolyte solution within the via results in a reduced plating rate at the base of the via relative to the field region. This voltage drop can be reduced by using an electrolyte having a relatively high acid concentration. For example, in some embodiments, the concentrated electrolyte solution contains an acid at a concentration of between about 0.1-2 M, such as between 0.4-2 M, e.g., between about 1-2M. In some embodiments, solutions with acid concentration of at least about 0.6 M are used. For example, sulfuric acid is used in some embodiments at a concentration range of between about 40 and 200 g/L, preferably at a concentration of at least about 60 g/L. For example, the concentrated electrolyte solution may contain $Cu^{2+}$ and $H_2SO_4$, where the solution is fully saturated at 0° C., or, in some embodiments, is fully saturated at 20° C., where the concentration of $H_2SO_4$ is relatively high, such as between about 100 and 200 g/L. Such concentrated solutions, are prepared in some embodiments by concentrating a solution containing $Cu^{2+}$ and one or more acids (e.g., $H_2SO_4$, an alk), where the volume of solution is reduced between about 1.5-3 fold. In other embodiments, such solutions are prepared by mixing acid solution with a solution containing $Cu^{2+}$.

The actual concentration of copper ion that can be achieved in the provided concentrated electrolyte will depend on selected operating temperatures and on the presence of other components, such as an acid having common anion. As the solubility of copper salts increases with increasing temperature, significantly higher concentrations of $Cu^{2+}$ cation can be achieved by maintaining and using the highly concentrated electrolyte at higher temperatures.

The solubility of a particular salt is given by its solubility product, $K_{sp}$. The salt precipitates after its solubility product value for a give temperature is reached. For example, for copper sulfate the solubility product is the product of copper ion and sulfate ion molar concentrations:

$$K_{sp}=[Cu^{2+}][SO_4^{2}].$$

Figure 3:
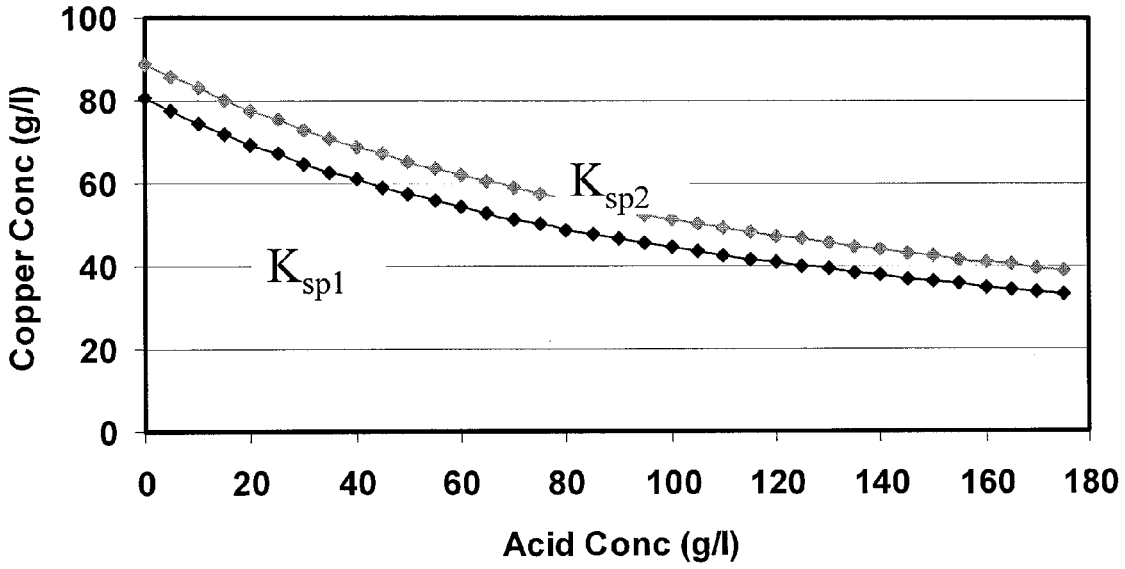
FIG. 3 is a plot illustrating copper and sulfuric acid concentrations attainable in electrolyte solutions at different temperatures.

For those electrolyte solutions which contain both copper sulfate and sulfuric acid, the increase in sulfuric acid concentration increases sulfate ion concentration and thereby causes precipitation of copper sulfate at a lower $Cu^{2+}$ concentration (compared to pure copper sulfate solution). This is illustrated, for example by a plot shown in FIG. 3, which shows $Cu^{2+}$ concentration (in g/L) and $H_2SO_4$ concentration (in g/L) at which solubility product is reached at 0° C. ($K_{sp1}$) and at about 20° C. ($K_{sp2}$). It can be seen that when acid concentration is 0, the solubility product is reached at 0° C. at $Cu^{2+}$ concentration of about 80 g/L. When the concentration of sulfuric acid is increased to about 120 g/L, the solubility product is reached at about 30° C. at lower $Cu^{2+}$ concentration of about 40 g/L.

Therefore, the concentration of $Cu^{2+}$ in provided highly concentrated electrolytes can differ in different embodiments depending on the operating temperatures and composition of solution. In some embodiments, the concentration of $Cu^{2+}$ is at least about 40 g/L, such as at least about 60 g/L, for example at least about 80 g/L, such as between about 100-200 g/L.

In some embodiments, the concentrated electrolyte contains at least one copper salt, for which the solubility product at 0° C. is exceeded, for example, by at least 5, 10, 20, or 50%, while the concentrated electrolyte is maintained at a temperature of at least about 20° C. In some embodiments, the concentrated electrolyte contains at least one copper salt, for which the solubility product at 20° C. is exceeded, for example, by at least 5, 10, 20, or 50%, while the concentrated electrolyte is maintained at a temperature of at least about 40° C.

Figure 4:
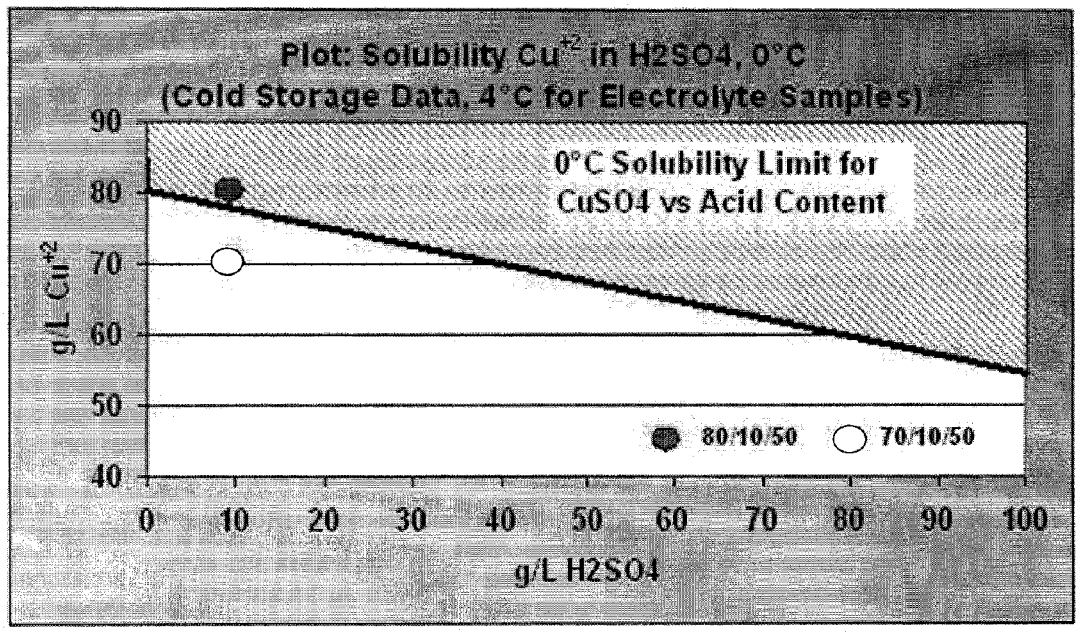
FIG. 4 is a plot illustrating solubility of copper salt in electrolyte solutions containing sulfuric acid at 0° C.

Exemplary suitable concentrated solutions are illustrated in the plot shown in FIG. 4, which illustrates saturation of $CuSO_4$ in the presence of sulfuric acid at 0° C. The marked area above the line illustrates the concentrations of $Cu^{2+}$ in g/L and $H_2SO_4$ in g/L which correspond to complete saturation at 0° C. For example, an electrolyte solution containing 80 g/L $Cu^{2+}$, 10 g/L $H_2SO_4$, and 50 mg/L $Cl^-$ represented by the black dot will be beyond saturation limit at 0° C., while a solution containing 70 g/L $Cu^{2+}$, 10 g/L $H_2SO_4$, and 50 mg/L $Cl^-$ will not exceed solubility product at this temperature.

In one example, the concentrated electrolyte solution contains copper sulfate and sulfuric acid, with $Cu^{2+}$ concentration of between about 60-120 g/L and $H_2SO_4$ concentration of between about 5-75 g/L. In some embodiments, provided electrolytes have the chemistry described in U.S. patent application Ser. No. 12/193,644, which was previously incorporated by reference.

Thus, the concentrated electrolyte solutions may contain one or more copper salts, and, optionally, an acid. The concentrated electrolyte solutions may be prepared in a number of ways. In one embodiment, the concentrated electrolyte solution is prepared from a less concentrated solution (also referred to as a non-concentrated solution) by removing water, such as by evaporation or reverse osmosis. In another embodiment the concentrated solution is prepared by combining a relatively concentrated solution containing copper salt with a solution of acid to form a solution that exceeds its saturation limit at 0° C. The formed solution is maintained at a temperature of at least about 20° C. In other embodiments, a combination of these methods may be used. For example, a relatively concentrated copper salt solution (e.g., having $Cu^{2+}$ concentration of greater than 65 g/L) can be combined with a concentrated or non-concentrated acid solution, and the resulting mixture may be concentrated, e.g., by evaporation or reverse osmosis, to achieve an even greater concentration of cupric ion (e.g., greater than 85 g/L). The formed solution may be maintained at room temperature, or elevated temperature depending on the level of concentration.

Referring again to the process shown in FIG. 2A, after the concentrated solution has been prepared, or concurrently with the preparation of concentrated electrolyte solution, one or more additives may be optionally introduced to the plating solution in operation 205. The additives typically include one or more of levelers, accelerators, suppressors, and surface-active agents, and are configured to increase electroplating rates at the recessed feature bottom relative to the plating rates in the field region, or, in other words, to suppress plating on the wafer field relative to the recessed feature bottom.

Accelerators may include a sulfur, oxygen, or nitrogen functional group that help to increase deposition rates and may promote dense nucleation leading to films with a fine grain structure. Accelerators may be present at a low concentration level, for example 0-200 ppm. While the accelerator may produce high deposition rates within the TSV hole, the accelerator may be transported away from the substrate top surface (field region) and/or consumed by reaction with oxygen in the bulk solution. Suppressors are additives that reduce the plating rate and are usually present in the plating bath at higher concentrations, for example 5-1,000 ppm. They are generally polymeric surfactants with high molecular weight, such as polyethylene glycol (PEG). The suppressor molecules slow down the deposition rate by adsorbing on the surface and forming a barrier layer to the copper ions. Because of their large size and low diffusion rate, suppressors are less likely to reach the lower part of the TSV than the wafer field resulting in lower concentrations at the bottom of the TSV. Therefore, most of suppressing effect occurs on the surface of the substrate (field region), helping to reduce overburden and avoid TSV hole "closing". Levelers are the additives whose purpose is to reduce surface roughness. They are present, if at all, in very small concentrations, such as 1-100 ppm, and their blocking effects at the surface are highly localized. As a result, levelers selectively reduce deposition mainly on the high spots allowing the low spots to level out. This behavior can also be used to enhance the plating rate of copper at the base of the TSV relative to the growth rate on the wafer field. In some cases, levelers may contain functional groups which include nitrogen atoms which exhibit a tendency to form complexes with Cu(I) ions at the wafer interface. Finally, chloride ions may be present in the plating bath at a concentration of no greater than about 300 ppm.

In some embodiments, the additives reduce the current density (and the plating rate) in the field and at the upper lip of the TSV twofold relative to the current density in the field that would have been obtained in the absence of additives. The additives help achieve void-free filling by increasing the relative plating rate at feature bottom relative to feature opening. The additives can operate in synergy with high concentration of $Cu^{2+}$ and high temperature conditions to achieve the goal of void-free filling, which is particularly important for high aspect ratio TSV filling.

After the electrolyte has been formed, in operation 207, the substrate is contacted with the highly concentrated electrolyte solution to at least partially fill the recessed feature. The temperature in the plating cell is controlled such that the precipitation of electrolyte is avoided. For example, if the electrolyte is saturated at 0° C. (as highest saturation temperature) then plating can be performed at 20° C. or higher. If the highest temperature at which the electrolyte is saturated is 20° C., the temperature in the plating bath can be maintained at 40° C. and higher. In some embodiments, plating is performed at a temperature of at least about 50° C., such as at a temperature of about 60° C.

The electrolyte can be provided to the plating cell continuously, semi-continuously, or incrementally. Optionally, as depicted in operation 209, the highly concentrated electrolyte solution is recirculated, for example by continuously or incrementally removing the highly concentrated electrolyte from an electrolyte exit port in the plating cell, passing it through a filter and optionally through a degasser and eventually returning it back to the plating cell. Care is taken to control the temperature of the concentrated electrolyte during recirculation in order to avoid inadvertent precipitation of copper salt.

Figure 2B:
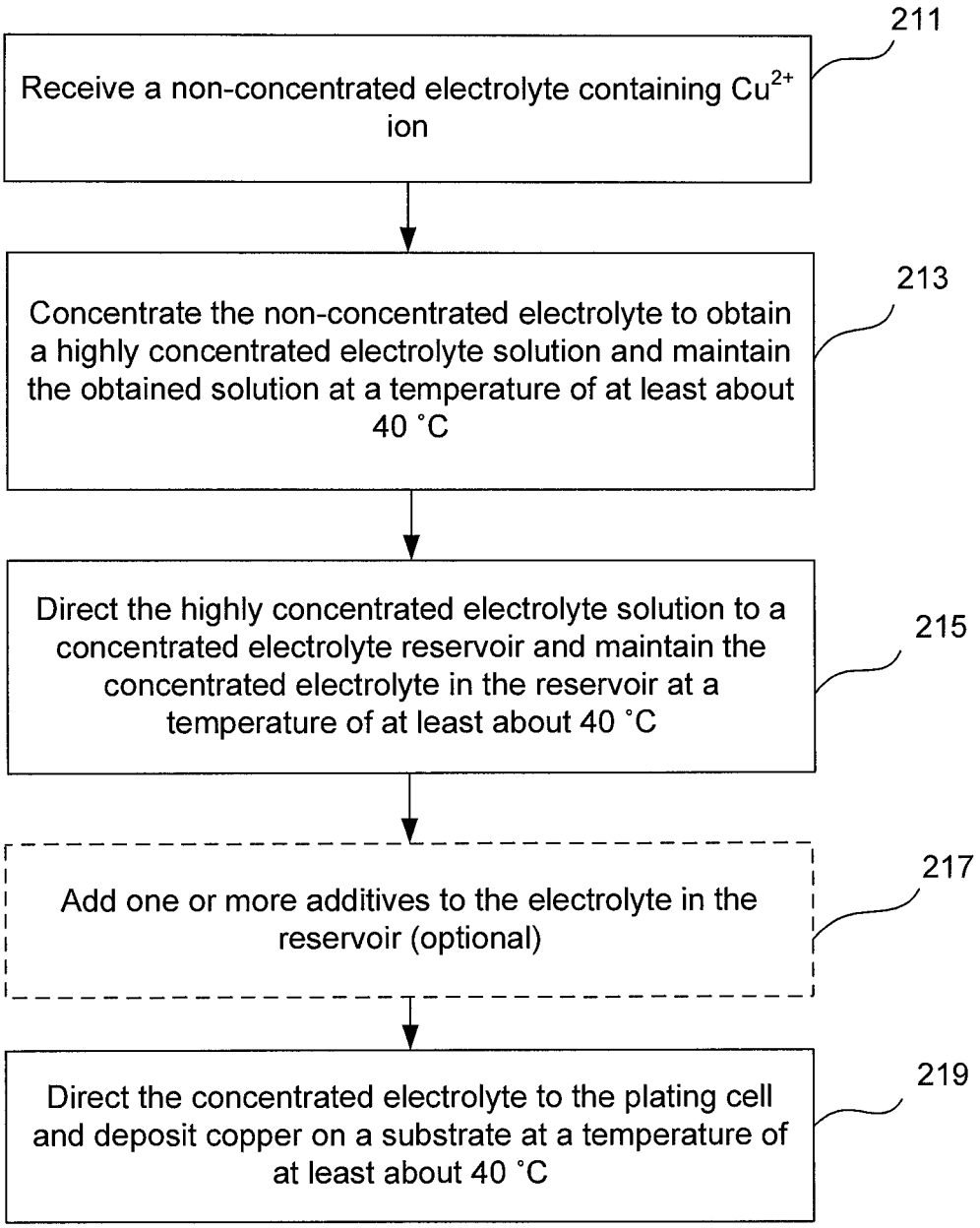
Figure 2C:
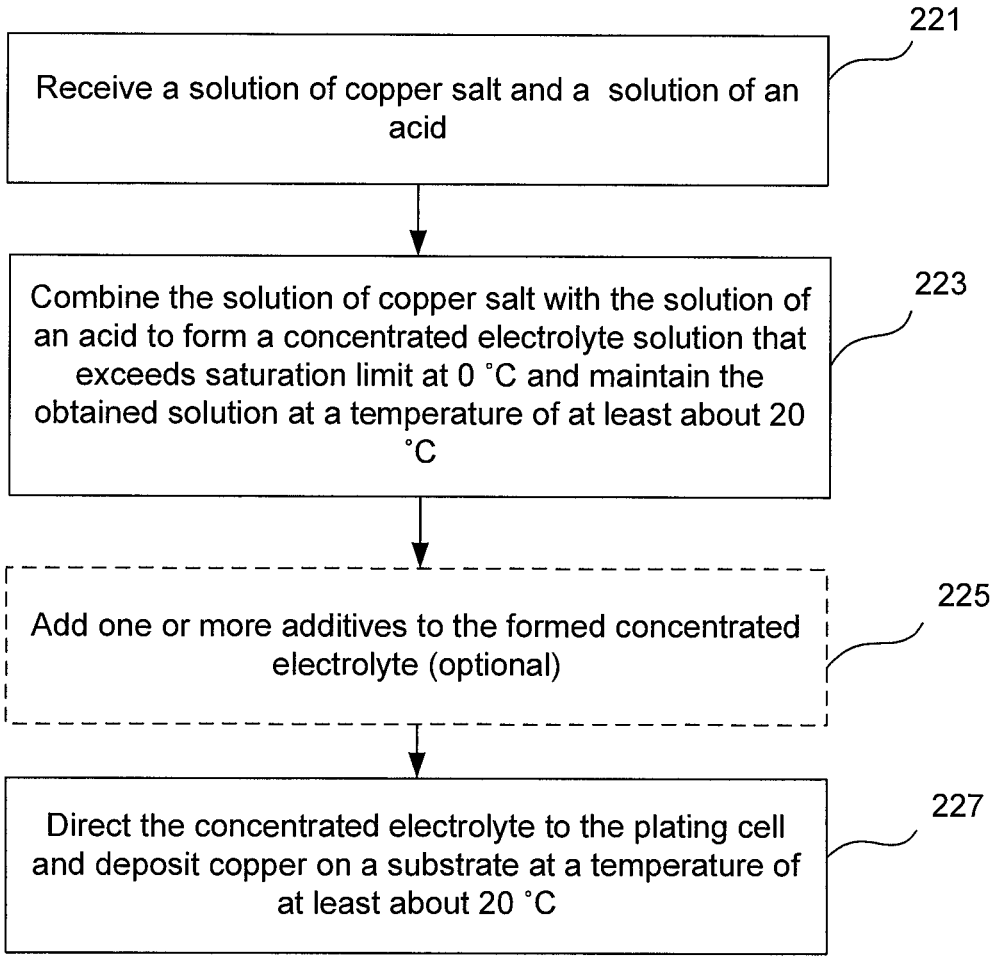

FIGS. 2B and 2C are illustrative examples of process flows which involve different methods of preparing concentrated electrolyte for plating. The process shown in FIG. 2B starts in 211 by receiving a non-concentrated electrolyte containing $Cu^{2+}$ ion. For example, the electrolyte can be an aqueous solution of copper salt, which optionally may include an acid. In some embodiments, the received non-concentrated electrolyte is a solution consisting essentially of copper salt (e.g., copper sulfate), an acid (e.g. sulfuric acid), and, optionally, a halide (e.g., chloride). In some embodiments, the non-concentrated solution may also include one or more organic additives. The concentration of $Cu^{2+}$ ion in the non-concentrated solution is such that the solution is not fully saturated at 20° C.,—that is the concentrations of components are below the concentrations that would have resulted in precipitation. For example, the non-concentrated solution can comprise a copper salt at less than about 90% of its $K_{sp}$ at 20° C., such as at less than about 80% of $K_{sp}$ at 20° C., or even less than about 50% of its $K_{sp}$ at 20° C. Non-concentrated solutions can be obtained commercially. For example a solution containing 40 g/L $Cu^{2+}$ and 10 g/L $H_2SO_4$ can be commercially obtained from ATMI, Danbury, Conn.

In operation 213 the non-concentrated electrolyte is concentrated to obtain a highly concentrated electrolyte solution. The obtained solution is maintained at a temperature of at least about 40° C. The formed highly concentrated solution would have been fully saturated (i.e. would have formed a precipitate) at 20° C., but is maintained at a temperature of at least about 40° C. (e.g., at a temperature of at least about 50° C.) such that copper salt or salts remain fully dissolved. The concentration can be performed in a concentrator module configured for removing water from non-concentrated solution and for controlling and maintaining required temperatures and concentrations in the prepared electrolyte solution. In some embodiments, the volume of solution is reduced about 1.5-3 fold. In some embodiments, water is removed by evaporation of water, which may be performed in a temperature range of between about 40-100° C., preferably at between about 80-100° C. In some embodiments the solution is brought to boiling and water is removed while the solution is boiled. Dry air may be introduced into the concentrated air module through a dry air port, and wet air may be removed through a wet air port to facilitate the concentration process. This type of concentrator module will be described in additional detail in the "Apparatus" section.

In other embodiments, the water is removed in the concentrator module by reverse osmosis. In these embodiments, the concentrator module will typically include a chamber or a line for providing the non-concentrated electrolyte solution, a semipermeable membrane connected with this chamber or line, and a chamber or a line configured for holding or discarding removed water. A high-pressure pump is included in the system, which exerts the required pressure on the electrolyte solution such that water passes through the semipermeable membrane, thereby concentrating the electrolyte. Once the electrolyte is sufficiently concentrated, care is taken to maintain it at a temperature of at least about 40° C. to avoid precipitation. The reverse osmosis concentrator may include one or more heaters, concentration detectors, and temperature detectors electrically connected with one or more controllers configured for controlling and maintaining concentrations and temperatures.

After the highly concentrated electrolyte has been prepared in the concentrator module, it is directed from an outlet port in the concentrator module to a concentrated electrolyte reservoir. As stated in operation 205, the concentrated electrolyte reservoir is configured to maintain the concentrated solution at a temperature of at least about 40° C. to avoid salt precipitation from the highly concentrated electrolyte. The concentrated electrolyte reservoir includes a vessel configured for holding the concentrated electrolyte. The reservoir typically includes a heater and a temperature sensor connected to a controller, which is configured to maintain the electrolyte at a desired temperature. The reservoir may also include a concentration sensor (e.g., an optical sensor configured for measuring optical density of the electrolyte solution) connected with a concentration controller. The temperature of the electrolyte in the reservoir need not necessarily be the same as the temperature of the electrolyte in the concentrator. While it is important that both in the concentrator and in the reservoir the temperature is maintained above the temperature at which precipitation occurs, these temperatures need not be identical. For example, in some embodiments, the water may be removed in the concentrator at a temperature of at least about 80° C., while the electrolyte may be maintained in the reservoir at lower temperatures of between about 40-65° C. Further, the composition of the concentrated electrolyte in the concentrator and in the reservoir need not necessarily be identical. For example, in some embodiments, the electrolyte in the reservoir may include organic additives, while the electrolyte in the concentrator may be additive-free, in order to minimize exposure of organic additives to high temperatures in the concentrator. In other embodiments, the concentrated electrolyte in the concentrator does not include an acid, and the acid is added to the electrolyte in the reservoir. Also, in some embodiments, the electrolyte in the concentrator may be more concentrated than the electrolyte in the reservoir (while both are highly concentrated and exceed saturation limit at 20° C.).

As shown in operation, 217 one or more additives may optionally be added to the electrolyte in the reservoir. The additives may include one or more of accelerators, suppressors and levelers, as previously described.

Next, in operation 219 the concentrated electrolyte is directed to the plating cell where it is contacted with the substrate to deposit copper at a temperature of at least about 40° C. (e.g., at a temperature of between about 40-80° C., such as at between about 50-75° C.). The temperature in the plating cell need not be necessarily the same as in the reservoir or in the concentrator but should be sufficient to keep the copper salts from precipitating from the electrolyte solution. The plating cell may include an electrolyte concentration sensor connected with the electrolyte concentration controller. In some embodiments the plating cell does not include a heater, and the warm concentrated electrolyte is supplied from the reservoir continuously or semi-continuously without allowing significant cooling of the electrolyte in the cell. In other embodiments, the plating cell may include a heater connected to a temperature controller. The described embodiment provides an integrated system for forming a highly concentrated electrolyte from commercially available non-concentrated electrolyte and for maintaining the electrolyte at an elevated temperature during preparation in the concentrator module, storage in the reservoir, and use in the plating cell.

Another embodiment involving preparation of highly concentrated electrolyte solution is shown in FIG. 2C. This method starts in operation 221 by receiving a solution of copper salt and a solution of an acid. For example a concentrated solution of copper sulfate having $Cu^{2+}$ concentration of between about 65-85 g/L is provided. Such concentrated solution can be purchased, e.g., from ATMI, Danbury, Conn. or prepared by dissolution of solid copper sulfate in water. In some embodiments copper sulfate solution having this or even higher concentration is prepared by dissolution of solid copper sulfate in water at an elevated temperature.

Further, a concentrated solution of sulfuric acid (e.g., 900-1800 g/L $H_2SO_4$) is provided. Concentrated sulfuric acid is readily commercially available. Next, in operation 223, the solution of copper salt is combined with the solution of the acid in a reservoir to form a concentrated electrolyte solution. In some embodiments, the resulting concentrated electrolyte solution exceeds its saturation limit (would have formed a precipitate) at 0° C., and the resulting solution is maintained at a temperature of at least about 20° C., e.g., at about 20-35° C. In other embodiments, the resulting highly concentrated solution exceeds it saturation limit at 20° C. and is maintained at a temperature of at least about 40° C.

The concentrated copper salt solution and the concentrated acid solution can be mixed in a reservoir, which may, depending on the embodiment, include a heater and a temperature controller. In some embodiments, the heat generated by mixing these components is utilized, and no additional heater may be required. In some embodiments the components are mixed in delivery lines without having a dedicated reservoir for holding the resulting highly concentrated solution.

In operation 225, one or more additives, such as accelerators, suppressors, levelers and their various combinations are optionally added to the highly concentrated electrolyte solution.

In operation 227, the solution is directed to the plating cell where the concentrated electrolyte contacts the substrate to deposit copper at a temperature that is sufficient for the concentrated electrolyte to be fully in solution. In some embodiments, the temperature during plating is between about 20-35° C. In other embodiments it is preferable to plate at a temperature of at least about 40° C., such as at a temperature of between about 40-65° C.

Effect of High Copper Concentration and High Temperature on Deposition Rates

Figure 5:
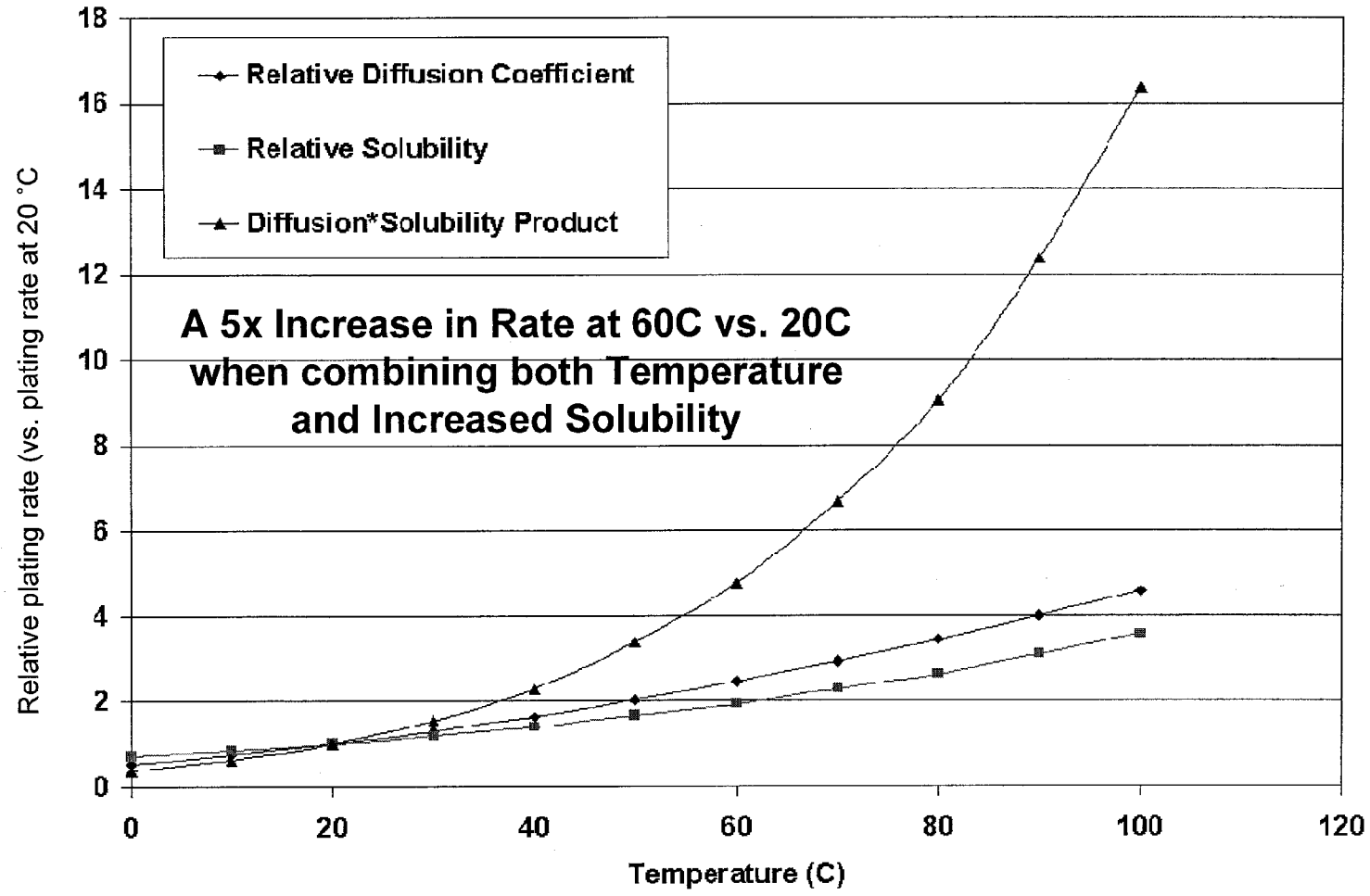
FIG. 5 is a computational modeling plot illustrating an increase in plating rates at higher temperatures due to increases in both solubility and in diffusion coefficient of $Cu^{2+}$ at higher temperatures.

During electroplating on substrates containing TSVs the maximum current of operation (and electroplating rate) is limited by the depletion of $Cu^{2+}$ ion near the base of the vias. This depletion is described in detailed in the U.S. application Ser. No. 12/193,644 which was previously incorporated by reference. By increasing the concentration of $Cu^{2+}$ in electrolyte solution, preferably in combination with increase in temperature of the electrolyte the current at the via base can be significantly increased. The increase in current and associated increase in the plating rate is both due to higher diffusion coefficient of copper at higher temperature and due to the greater concentration of $Cu^{2+}$ ions in the bulk solution that can be achieved at higher temperature. The actual observed plating rate correlates with the product of these two parameters, and, therefore, unexpectedly high rates of plating can be achieved with highly concentrated electrolytes at elevated temperatures. FIG. 5 illustrates how relative diffusion coefficient (diamond-marked curve), relative copper solubility (square-marked curve), and their product (triangle-marked curve) increase with increasing temperature. All parameters are related to corresponding parameters at 20° C. Thus, all three parameters at 20° C. have the value of 1. When temperature is increased from 20° C. to 60° C., the relative solubility of copper sulfate increases to about 2, while $Cu^{2+}$ diffusion coefficient increases to about 2.5. The plating rate which correlates with the product of these values, will, accordingly be increased to about 5, relative to the plating rate observed at 0° C.

FIG. 5 illustrates how the maximum plating rate varies as a function of temperature due to both the effect of increased copper solubility and increased diffusion coefficient. It is seen that diffusion and solubility effects taken separately, have a similar degree of benefit as a function of temperature, and that the combined benefit is a product of the individual effects. As a result, the relative diffusion limited current becomes very large when high temperature plating is used in combination with the use of highly concentrated electrolytes that can be attained at high temperatures. This effect of sharply higher capability to deliver $Cu^{2+}$ ion to the plated interface due to the combination in increase in diffusion coefficient and copper bulk concentration allows for more rapid $Cu^{2+}$ ion replenishment in the TSV bottoms at a given current setting.

Table 2 lists computer modeling results illustrating concentration, voltage, and current profile behavior in TSVs as a function of higher copper concentration and increased temperature. The modeling shows that nearly a six-fold increase in plating rate (and TSV base current) can be achieved while maintaining a constant degree of cupric ion depletion near the feature base when the copper concentration is increased from 60 to 120 g/L and the bath temperature is increased from 20 to 65° C.

TABLE 2

| | Field current | Via base current | Voltage drop in via | Cu depletion at via base |
|---|---|---|---|---|
| Case 1: 20 C. 60 g/L Cu 10 g/L Acid | 3.6 mA/cm2 | 1.6 mA/cm2 | 3.8 mV | 35% |
| Case 2: 65 C. 60 g/L Cu 10 g/L Acid | 12 mA/cm2 | 5.3 mA/cm2 | 5.2 mV | 39% |
| Case 3: 65 C. 120 g/L Cu 20 g/L Acid | 22 mA/cm2 | 9.6 mA/cm2 | 4.9 mV | 36% |

Apparatus

The apparatus for practicing described methods typically includes one or more plating cells and one or more modules for preparing concentrated electrolyte solution, where the modules are configured for providing concentrated electrolyte into the plating cells. The apparatus also includes a controller, which controls electrolyte concentrations and temperatures during various stages of electrolyte preparation and use, and is configured to prevent precipitation of copper salts during electrolyte preparation and use. In some embodiments the apparatus includes a reservoir configured for holding the concentrated electrolyte (e.g., during or after preparation) and delivering it to the plating cell. In some embodiments, the reservoir is configured for preparing and/or storing concentrated electrolyte solution at a volume that is between about 10-50% greater than the volume of electrolyte in the plating cell during use.

Figure 6:
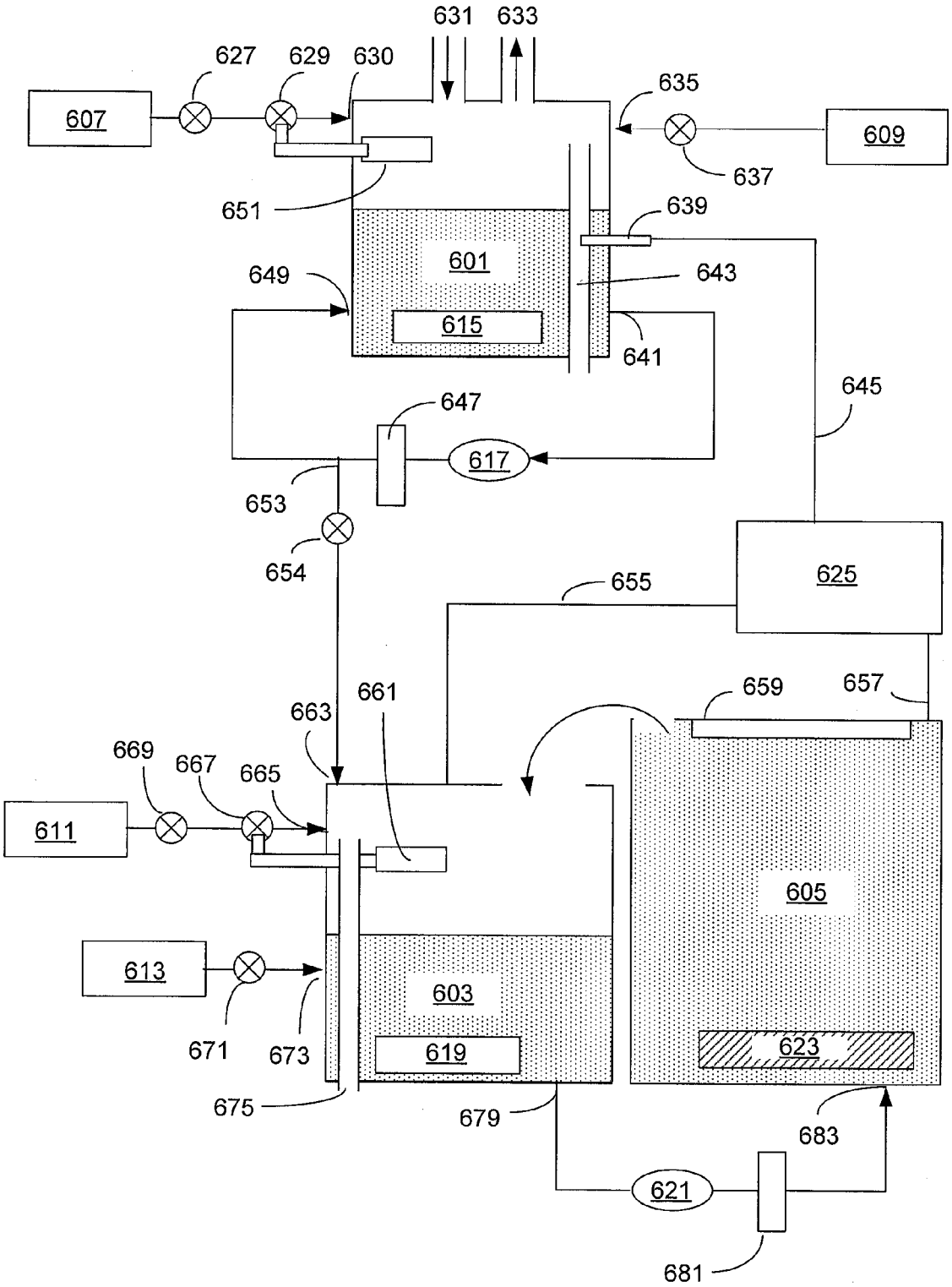
FIG. 6 is a simplified schematic presentation of an electroplating apparatus equipped with a concentrator module in accordance with an embodiment presented herein.
Figure 7:
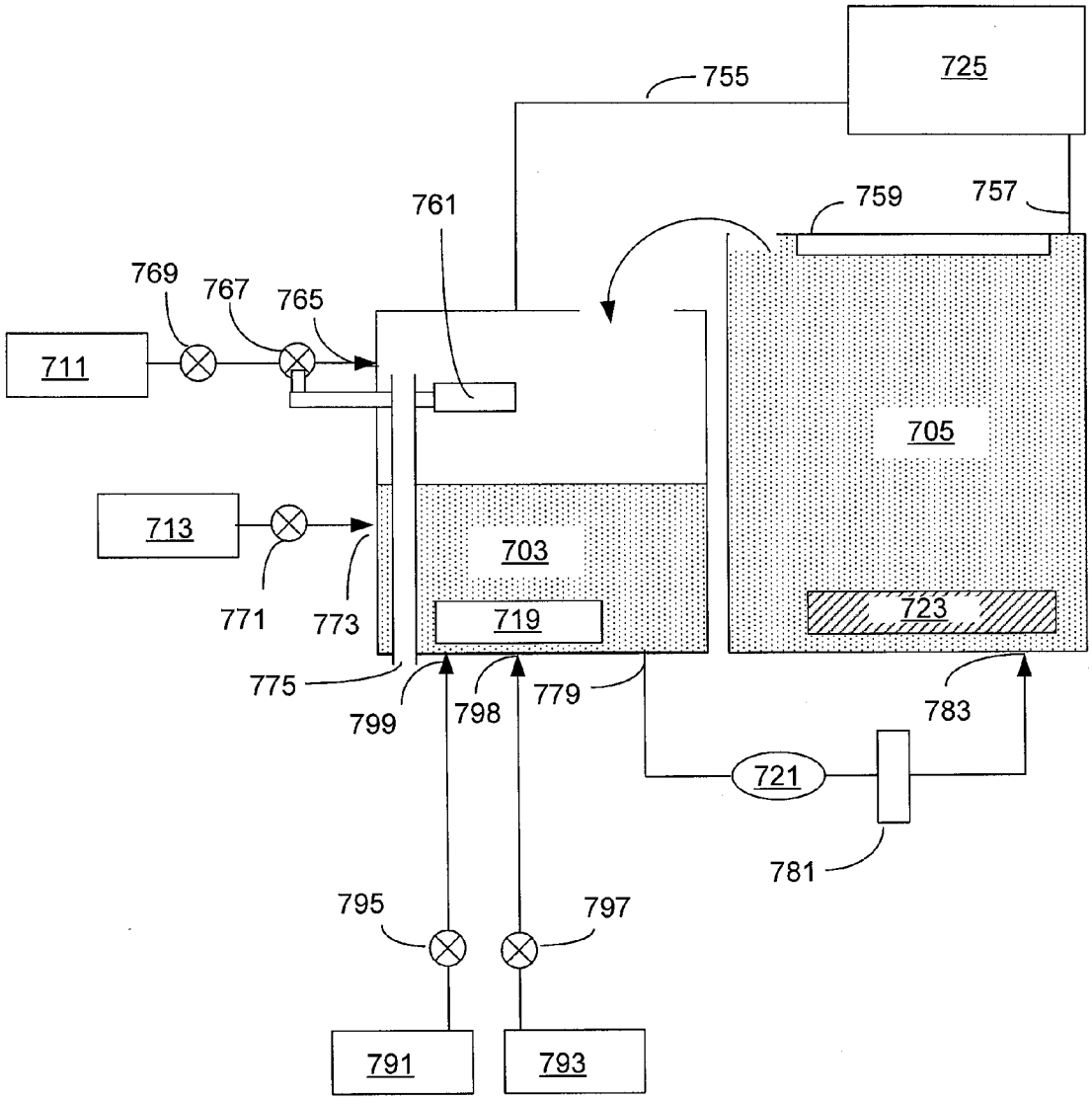
FIG. 7 is a simplified schematic presentation of an electroplating apparatus adapted for forming a concentrated electrolyte solution in accordance with another embodiment presented herein.

FIGS. 6 and 7 provide simplified schematic presentations of two different types of apparatus in accordance with the embodiments provided herein. It is understood that these are exemplary configurations, and that various modifications of these configurations are possible, as will be appreciated by one of skill in the art.

FIG. 6 illustrates an apparatus having a concentrator module 601, a reservoir 603, and a plating cell 605. This apparatus is suitable for practicing the plating method illustrated by the process flow diagram shown in FIG. 2B. In the configuration presented in FIG. 6, the non-concentrated electrolyte is concentrated in the concentrator module 601 by high-temperature evaporation. The non-concentrated electrolyte is provided from the source of non-concentrated electrolyte 609, which may be a tank configured for holding non-concentrated copper salt, and, optionally, an acid. In one embodiment source 609 holds copper sulfate and sulfuric acid at such concentrations that the solution is not saturated at 0° C. The non-concentrated electrolyte solution is delivered through the non-concentrated electrolyte entry port 635 into the concentrator 601. The delivery of the non-concentrated solution is controlled by a valve 637. The non-concentrated electrolyte may be a copper salt solution which may optionally include an acid. In other embodiments the concentrator receives copper salt from a source of a copper salt, and, separately, an acid from a source of an acid, and the components are mixed within the concentrator.

The concentrator is equipped with a heater 615 a temperature sensor (not shown) and an optical concentration sensor 639, which are connected to the controlling unit 625 (only one connection 645 is shown to preserve clarity). The concentrator is further has an inlet port 630 adapted for receiving a diluent, such as deionized water from a diluent source 651. The flow of diluent is controlled by valves 627 and 629, of which valve 629 is connected with an overflow shutoff member 651 configured to close valve 629 if overflow is detected in the concentrator module. The concentrator also includes an emergency overflow conduit 643, which is configured to remove excess electrolyte if the electrolyte level exceeds a threshold value. In some embodiments the overflow concentrated electrolyte is diluted in the overflow conduit 643 or afterwards to prevent precipitation of copper salts upon cooling of overflow. The concentrator 601 further includes a recirculation loop for recirculating concentrated electrolyte and for directing the concentrated electrolyte to the concentrated electrolyte reservoir. The concentrator includes an outlet port 641 through which the concentrated electrolyte exits the concentrator vessel. The concentrated electrolyte is pumped with the use of pump 617 through filter 647 and is optionally passed through a degasser (not shown) and is returned to the concentrator vessel through entry port 649. The concentrated electrolyte can be diverted from the recirculation loop at junction 653 and can be directed to the concentrated electrolyte reservoir 603, which it enters at the concentrated electrolyte entry port 663. The flow of concentrated electrolyte to the concentrated electrolyte reservoir is controlled by valve 654. The concentrator module 601 in the illustrated embodiment is configured to heat the electrolyte to a temperature of at least about 40° C., such as to at least about 80° C. and to remove water by evaporation. To facilitate evaporation of water the concentrator vessel includes an entry port 631 configured for receiving dry air and an exit port 633 configured for removing wet air. It is understood that a variety of alternative ways to facilitate removal of water in the concentrator may be used. For example in some embodiments, water may be removed under reduced pressure. The concentrator is configured to produce a highly concentrated electrolyte that would have been fully saturated at 0° C., and, in some embodiments, an electrolyte that would have been fully saturated at 20° C. In some embodiments the concentrator reduces the volume of received non-concentrated electrolyte by at least 1.5 times, such as by between about 1.5-3 times. In other embodiments the concentrator module is adapted for removing water by other methods, such as by reverse osmosis. A concentrator adapted for reverse osmosis has been previously described with reference to FIG. 2B.

After the concentrated electrolyte solution exits the concentrator recirculation loop at 653 it is directed to the concentrated electrolyte reservoir 603 through port 663. The concentrated electrolyte reservoir is configured for holding the concentrated solution and for delivering it to the plating cell 605. The reservoir in this configuration is equipped with an immersion heating element 619 and a temperature sensor and is configured for maintaining the electrolyte at a temperature of at least about 40° C., such as at about 40-80° C., e.g., at between about 40-65° C., or at about 50-65° C. The reservoir may also include one or more concentration sensors. Any of the temperature and concentration sensors as well as the heating element may be electrically connected through connection 655 to the controller unit 625 which is configured to control temperature and concentration of electrolyte in the reservoir in order to maintain the desired high concentration and to keep the copper salts from precipitating in the reservoir. Similarly to the concentrator, the reservoir 603 includes an inlet port 665 configured for addition of diluent, such as deionized water. The diluent is supplied from the diluent source 611, with the flow of diluent being controlled by valves 669 and 667. The valve 667 is connected with the overflow shut-off member 661, which closes the valve 667, when the level of electrolyte in the reservoir reaches a threshold value. The reservoir also includes an emergency electrolyte overflow conduit, which operates similarly to the conduit 643 in the concentrator module. Further, in the provided configuration, the reservoir has an inlet 673 which is configured for receiving electrolyte additives (such as one or more of levelers, accelerators and suppressors), which are delivered from the additive source 613 and are controlled by a valve 671.

In the described configuration the reservoir is adapted for providing the concentrated electrolyte to the plating cell 605 in a continuous or semi-continuous manner. The concentrated electrolyte (which in this embodiment contains copper salt, acid, and additives) is directed through outlet port 679, pump 621, filter 681, and optionally, a degasser to the inlet port 683 of the plating cell. Because the warm electrolyte solution from the reservoir is pumped into the plating cell continuously or semi-continuously, in the depicted configuration it is not necessary to include a heater element in the plating cell. In some embodiments it is possible to maintain the temperature of the electrolyte in the plating cell within about 5° C., such as within about 3° C. of the electrolyte temperature in the reservoir by continuous or semi-continuous pumping. In other embodiments, a heater may be included within the plating cell. The plating cell 605 includes a vessel adapted for holding the electrolyte, a wafer holder (not shown) which is adapted to hold wafer 659 and a motor adapted for rotating the wafer. Within the vessel an anode 623 is disposed typically opposite the wafer 659. The wafer (the cathode) and the anode are electrically connected to a power supply, which provides an appropriate current to the wafer, biasing it negatively versus the anode. As it was previously mentioned, the wafer includes a conductive seed layer on it surface, to which electrical connections are made typically at the periphery of the wafer. During plating, the copper ions in the electrolyte move towards the wafer are reduced at the wafer surface forming the electrodeposited copper layer. The provided depiction of the copper plating cell 605 is simplified to preserve clarity. It is understood that the plating cell may include multiple additional elements. For example, in some embodiments, the plating cell may include an ionically resistive ionically permeable member, such as an insulating plate having multiple non-interconnecting holes, which is disposed in close proximity of the wafer to improve plating uniformity. Further, in some embodiments, the anode in the plating cell may include several segments, which may be surrounded by focusing walls adapted to focus and shape current within the plating cell. Further, the plating cell may include a second cathode (a negatively biased conductive member) adapted to divert current from the edge of the wafer. Further, in some embodiments the anode may be separated from the cathode by an ionically permeable membrane thereby creating separate anode and cathode chambers within the plating cell. It is understood that a variety of different plating cell configurations may be used in conjunction with concentrated electrolyte preparation module described herein.

In the described configuration the electrolyte in the plating cell is recirculated back to the reservoir 603 simply by overflow from the plating cell. In other embodiments, the recirculation loop may include overflow of electrolyte from the reservoir 603 into the plating cell 605 and subsequent direction of used electrolyte back to the reservoir 603 through an exit port, and an exit line equipped with a pump and a filter. In an alternative embodiment, which is not depicted, electrolyte from the plating cell 605 is directed to the concentrator module 601, e.g., by overflow from the plating cell or by a separate line (typically equipped with a pump, filter, and a valve) connecting the plating cell and the concentrator. The electrolyte is then recirculated back to the plating cell from the concentrator through the reservoir.

In some embodiments, the concentrated electrolyte leaving the plating cell 605 is diluted to a concentration at which the electrolyte is stable at 20° C. and is directed to one or more vessels for storage, e.g., during tool idle time. In some embodiments, the diluted electrolyte is directed to the source of non-concentrated electrolyte 609, which is in fluidic communication with the concentrator.

The plating cell may also include one or more temperature and concentration detectors connected through electrical connection 657 to the controller unit 625.

The controller unit 625 may be manually controlled or may include a set of program instructions. The controller may control all or some aspects of electrolyte concentration process, electrolyte storage in the reservoir, and plating. Specifically the controller is adapted to control concentration and temperature in at least one of the concentrator module, the concentrated electrolyte reservoir, and the plating cell, such that desired concentrations are achieved and such that precipitation of copper salts is avoided.

The controller will typically include one or more memory devices and one or more processors. The processor may include a CPU or computer, analog and/or digital input/output connections, stepper motor controller boards, etc.

In certain embodiments, the controller controls all of the activities of the electroplating apparatus. The system controller executes system control software including sets of instructions for controlling one or more of temperature in the concentrator, reservoir, or the plating cell, flow of non-concentrated electrolyte into the concentrator, flow of the diluent into the concentrator, flow of the concentrated electrolyte into the reservoir, flow of the diluent into the reservoir, flow of the concentrated electrolyte into the plating cell and other parameters of a particular process. For example, the controller may be adapted to raise the temperature and/or to add the diluent if the electrolyte in the concentrator or reservoir becomes too concentrated or precipitates. The controller may further include instructions for controlling the flow rate from the reservoir to the plating cell, such that the electrolyte does not cool down significantly within the plating cell.

Other computer programs stored on memory devices associated with the controller may be employed in some embodiments.

Typically there will be a user interface associated with controller 625. The user interface may include a display screen, graphical software displays of the apparatus and/or process conditions, and user input devices such as pointing devices, keyboards, touch screens, microphones, etc.

The computer program code for controlling the deposition and resputtering processes can be written in any conventional computer readable programming language: for example, assembly language, C, C++, Pascal, Fortran or others. Compiled object code or script is executed by the processor to perform the tasks identified in the program.

The controller parameters relate to process conditions such as, for example, non-concentrated electrolyte composition and flow rates, temperature, additive solution flow rates, etc. These parameters are provided to the user in the form of a recipe, and may be entered utilizing the user interface.

Signals for monitoring the process may be provided by analog and/or digital input connections of the system controller. The signals for controlling the process are output on the analog and digital output connections of the deposition apparatus.

The system software may be designed or configured in many different ways. For example, various apparatus component subroutines or control objects may be written to control operation of the chamber components necessary to carry out the inventive deposition processes. Examples of programs or sections of programs for this purpose include temperature control code, concentration control code, etc.

Examples of sensors that may be monitored by the controller during electrolyte preparation and plating include optical concentration detectors, mass flow controllers, density meters, and temperature sensors in the concentrator module, reservoir, or the plating cell. Further, level of electrolyte in the concentrator, reservoir, and the plating cell can be monitored. Appropriately programmed feedback and control algorithms may be used with data from these sensors to maintain desired process conditions. For example, in some embodiments, the controller is configured for rapidly diluting electrolyte and containing the added volume in the concentrator, reservoir, or plating cell, upon drop in temperature or inadvertent concentration increase to prevent precipitate formation. For example, the controller may be programmed to add water to a predetermined level in one or more of these vessels upon non-planned shut-off of the system, e.g., in response to high concentration or low temperature reading. The system is also equipped with cut-off valves to prevent overflow, which can stop the flow of diluent after the electrolyte reaches a desired level.

In some embodiments the controller includes program instructions to perform the method described with reference to FIG. 2B.

EXAMPLE

In one illustrative example, a non-concentrated electrolyte solution containing copper sulfate and sulfuric acid at a concentration of 60 g/L $Cu^{2+}$ and 20 g/L $H_2SO_4$ is added from the tank 609 to the concentrator 601. In the concentrator, the electrolyte is evaporated to 50% of its volume resulting in an electrolyte having a concentration of 120 g/L $Cu^{2+}$ and 40 g/L $H_2SO_4$. The electrolyte is then directed to the reservoir 603, and subsequently to the plating cell 605, while temperature of the electrolyte is always maintained at about 60° C. and above. The plating of copper on the substrate is performed at 60° C. In this case the improvement in plating rate relative to the room temperature bath having 60 g/L $Cu^{2+}$ concentration is about 5-fold, which is the product of 2.5-fold increase due to increase in diffusion coefficient at high temperature, and 2-fold increase due to cupric ion concentration increase.

In another apparatus configuration, the apparatus does not include a concentrator module, but includes a preparation module adapted for preparing a concentrated electrolyte by combining a concentrated copper salt and a concentrated acid. This configuration is illustrated in FIG. 7, and is suitable for performing a method shown in FIG. 2B. The apparatus includes a reservoir 703 which is adapted to receive a concentrated solution of copper salt through inlet port 799 from the source of concentrated copper salt 791. The flow of concentrated copper salt is controlled by the valve 795. The reservoir 703 also includes an inlet port for receiving concentrated acid solution from the source of concentrated acid 793, where the flow of acid is controlled by a valve 798. The concentrated solutions of copper salt and acid are mixed in the reservoir 703 to form a solution that would have been fully saturated at 0° C., or, in some embodiments, fully saturated at 20° C. The temperature in the reservoir is controlled such that the formed electrolyte remains fully in solution. For example in some embodiments, the electrolyte is maintained at a temperature of between about 20-35° C. In some embodiments, it is preferable to maintain the electrolyte at a temperature of at least about 40° C., such as at a temperature of between about 40-65° C. The reservoir will typically include an immersion heater 719 and temperature detectors connected with the controller unit 725 which is adapted to control the temperature in the reservoir. The reservoir may also include a concentration detector (not shown) connected to the controller 725. Similarly to the reservoir depicted in FIG. 6, the reservoir 703 includes an inlet port 773 adapted for receiving electrolyte additives from an additive source 713, controllable by valve 771. The reservoir also includes an emergency overflow conduit 775, and an overflow shutoff valve 767 connected to member 761, which is adapted to close the delivery of the diluent at diluent port 765 from the diluent source 711. The diluent flow can also be controlled by valve 769. The concentrated electrolyte from the reservoir 703 is directed to the plating cell 705 to contact the substrate 759. The plating cell in this embodiment is configured similarly to the plating cell described in FIG. 6

EXAMPLE

In one illustrative example, a solution containing copper sulfate at $Cu^{2+}$ concentration of between about 65-85 g/L is directed from source 791 to the reservoir 703. The solution in the reservoir is heated to a temperature of about 35° C., and then sulfuric acid having a concentration of between about 900-1800 g/L is added to the reservoir and is mixed with the solution of copper sulfate to form a concentrated solution having 60-80 g/L $Cu^{2+}$ and between about 5-50 g/L sulfuric acid. The resulting concentrated solution is directed to the plating cell 705, where copper is electrodeposited on the substrate at a temperature of about 30-35° C.

Although various details have been omitted for clarity's sake, various design alternatives may be implemented. Therefore, the present examples are to be considered as illustrative and not restrictive, and the invention is not to be limited to the details given herein, but may be modified within the scope of the appended claims. For example, in some embodiments, the concentrator module need not be necessarily a separate unit connected with the reservoir by tubing, but may reside physically within the reservoir. In other embodiments, the reservoir is not used in the apparatus configuration, and the concentrated electrolyte solution is flowing directly from the concentrator module into the plating cell. Yet in other embodiments, the concentrated electrolyte is prepared from copper salt and acid within the lines connected to the plating cell, without having a separate reservoir for mixing. Suitable temperature of the electrolyte can be achieved partially or fully due to exothermic mixing of concentrated acid solution with the solution of the salt.

What is claimed is:

1. An electroplating apparatus for depositing copper on a semiconductor substrate having one or more recessed features, the apparatus comprising:

(a) an electrolyte concentrator module configured for concentrating an electrolyte comprising a dissolved copper salt by removing water from the electrolyte using water evaporation, the electrolyte concentrator module comprising an inlet port configured for receiving a non-concentrated electrolyte from a source of non-concentrated electrolyte, an outlet port configured for delivering warm concentrated electrolyte to a concentrated electrolyte reservoir, a dry air port configured for introducing dry air, a wet air port configured for removing wet air containing evaporated water, and a heater configured for maintaining the electrolyte in the concentrator module at a temperature of at least about 40° C.;

(b) the concentrated electrolyte reservoir in fluidic communication with the concentrator module, wherein the reservoir is configured for receiving the warm concentrated electrolyte from the concentrator module and for delivering the warm concentrated electrolyte to an electroplating cell;

(c) the electroplating cell in fluidic communication with the concentrated electrolyte reservoir, wherein the electroplating cell is configured for receiving the warm concentrated electrolyte from the concentrated electrolyte reservoir, and for bringing the warm concentrated electrolyte in contact with the semiconductor substrate at the electrolyte temperature of at least about 40° C. ; and (d) a controller comprising program instructions for (i) providing dry air to the electrolyte concentrator module through dry air port; and (ii) concentrating the electrolyte in the concentrated electrolyte would have formed a precipitate at 20 ° C.

2. The electroplating apparatus of claim 1, further comprising the source of non-concentrated electrolyte in fluidic communication with the concentrator module, wherein the source of non-concentrated electrolyte is configured for holding the non-concentrated electrolyte and for delivering the non-concentrated electrolyte to the inlet port of the concentrator module.

3. The electroplating apparatus of claim 1, wherein the electroplating cell is configured for bringing the substrate in contact with the concentrated electrolyte at the electrolyte temperature of at least about 50° C.

4. The electroplating apparatus of claim 1, wherein the electroplating cell is configured for bringing the substrate in contact with the concentrated electrolyte at the electrolyte temperature of at least about 60° C.

5. The electroplating apparatus of claim 1, wherein the concentrated electrolyte reservoir comprises a heater configured for maintaining the temperature of the warm concentrated electrolyte in the reservoir at least at about 40° C.

6. The electroplating apparatus of claim 1, wherein the concentrator module comprises an electrolyte concentration detector.

7. The electroplating apparatus of claim 1, wherein the concentrator module comprises an inlet configured to receive a diluent from a diluent source.

8. The electroplating apparatus of claim 1, wherein the concentrator module is configured for concentrating an electrolyte solution by evaporating water from the electrolyte solution at a temperature of at least about 70° C.

9. The electroplating apparatus of claim 1, wherein the concentrator module is configured for concentrating an electrolyte solution consisting essentially of water, $Cu^{2+}$, and one or more anions.

10. The electroplating apparatus of claim 1, wherein the concentrator module is configured for concentrating an electrolyte solution consisting essentially of water, $Cu^{2+}$, $H^{+}$, sulfate, and chloride.

11. The electroplating apparatus of claim 1, wherein the concentrator module comprises a recirculation line connected to the electrolyte outlet port, the line configured for recirculating the warm concentrated electrolyte within the concentrator module and comprising a filter configured for filtering the recirculated electrolyte, wherein the recirculation line is in fluidic communication with the concentrated electrolyte reservoir, and is further configured for delivering the warm filtered concentrated electrolyte to the concentrated electrolyte reservoir.

12. The apparatus of claim 1, wherein the electroplating cell is configured for electrolyte recirculation, and wherein the electroplating cell comprises an electrolyte exit port and an electrolyte exit line configured to deliver the electrolyte from the electroplating cell to the concentrated electrolyte reservoir.

13. The apparatus of claim 1, wherein the electroplating cell is configured for electrolyte recirculation, and wherein the electroplating cell comprises an electrolyte exit port and an electrolyte exit line configured to deliver the electrolyte from the electroplating cell to the concentrator module.

14. The apparatus of claim 1, wherein the electroplating cell is configured for continuous delivery of the warm concentrated electrolyte from the concentrated electrolyte reservoir to the electroplating cell during electroplating on the substrate.

15. The apparatus of claim 14, wherein the electroplating cell does not include a heater.

16. The apparatus of claim 1, wherein the concentrated electrolyte reservoir is configured for receiving one or more additives selected from the group consisting of a leveler, an accelerator and a suppressor, from an additive source.

17. The electroplating apparatus of claim 1, wherein the apparatus comprises an electrolyte concentration controller and an electrolyte temperature controller, wherein the electrolyte concentration controller is configured to process electrolyte concentration measurements and to deliver a desired amount of diluent in order to maintain the copper ion concentration of the warm concentrated electrolyte delivered to the plating cell at a concentration above the concentration saturation limit at 20° C., and wherein the electrolyte temperature controller is configured to maintain the temperature of the warm concentrated electrolyte delivered to the plating cell at least at 40° C.

18. An electroplating apparatus for depositing copper on a semiconductor substrate having one or more recessed features, the apparatus comprising:

(a) a concentrated electrolyte reservoir in fluidic communication with a source of concentrated copper salt and with a separate source of a concentrated acid, the reservoir configured for combining the concentrated solution of copper salt with the concentrated acid and forming a warm concentrated electrolyte solution having a temperature of at least about 40° C., wherein said solution would have formed a precipitate at 20° C.; and (b) an electroplating cell in fluidic communication with the concentrated electrolyte reservoir, wherein the electroplating cell is configured for receiving the warm concentrated electrolyte from the concentrated electrolyte reservoir, and for bringing the warm concentrated electrolyte in contact with the semiconductor substrate at the electrolyte temperature of at least about 40° C. and (c) a controller comprising program instructions for:

(i) introducing the concentrated solution of copper salt and heating the concentrated solution of copper salt in the concentrated electrolyte reservoir; and (ii) combining the heated concentrated solution of copper salt with the concentrated acid.

19. An electroplating apparatus for depositing copper on a semiconductor substrate having one or more recessed features, the apparatus comprising:

(a) an electrolyte concentrator module configured for concentrating an electrolyte comprising a dissolved copper salt by removing water from the electrolyte using reverse osmosis, the electrolyte concentrator module comprising an inlet port configured for receiving a non-concentrated electrolyte from a source of non-concentrated electrolyte, an outlet port configured for delivering warm concentrated electrolyte to a concentrated electrolyte reservoir, and a heater configured for maintaining the electrolyte in the concentrator module at a temperature of at least about 40 ° C.;

(b ) the concentrated electrolyte reservoir in fluidic communication with the concentrator module, wherein the reservoir is configured for receiving the warm concentrated electrolyte from the concentrator module and for delivering the warm concentrated electrolyte to an electroplating cell; and (c) the electroplating cell in fluidic communication with the concentrated electrolyte reservoir, wherein the electroplating cell is configured for receiving the warm concentrated electrolyte from the concentrated electrolyte reservoir, and for bringing the warm concentrated electrolyte in contact with the semiconductor substrate at the electrolyte temperature of at least about 40 ° C.; and (d) a controller comprising program instructions for concentrating the electrolyte in the concentrator module by removing water from the non-concentrated electrolyte via reverse osmosis to form the concentrated electrolyte, wherein the concentrated electrolyte would have formed a precipitate at 20° C.

* * * * *